US010225657B2

(12) United States Patent
Seldess et al.

(10) Patent No.: US 10,225,657 B2
(45) Date of Patent: Mar. 5, 2019

(54) SUBBAND SPATIAL AND CROSSTALK CANCELLATION FOR AUDIO REPRODUCTION

(71) Applicant: Boomcloud 360, Inc., Encinitas, CA (US)

(72) Inventors: Zachary Seldess, San Diego, CA (US); James Tracey, San Diego, CA (US); Alan Kraemer, San Diego, CA (US)

(73) Assignee: Boomcloud 360, Inc., Encinitas, CA (US)

( * ) Notice: Subject to any disclaimer, the term of this patent is extended or adjusted under 35 U.S.C. 154(b) by 0 days.

(21) Appl. No.: 15/409,278

(22) Filed: Jan. 18, 2017

(65) Prior Publication Data

US 2017/0208411 A1 Jul. 20, 2017

Related U.S. Application Data

(63) Continuation of application No. PCT/US2017/013061, filed on Jan. 11, 2017.
(Continued)

(51) Int. Cl.
*H04R 5/04* (2006.01)
*H04S 1/00* (2006.01)
(Continued)

(52) U.S. Cl.
CPC ..... *H04R 5/04* (2013.01); *G10L 21/0232* (2013.01); *H04S 1/002* (2013.01);
(Continued)

(58) Field of Classification Search
CPC . H04S 1/002; H04S 3/002; H04S 7/30; H04S 2420/01; H04S 2420/07
See application file for complete search history.

(56) References Cited

U.S. PATENT DOCUMENTS 3,920,904 A 11/1975 Blauert et al.
4,910,778 A 3/1990 Barton
(Continued)

FOREIGN PATENT DOCUMENTS

CN 100481722 C 4/2009
CN 102007780 A 4/2011
(Continued)

OTHER PUBLICATIONS

Korean Notice of Allowance, Korean Application No. 10-2017-7031417, dated Apr. 6, 2018, 4 pages.
(Continued)

*Primary Examiner* — Duc Nguyen
*Assistant Examiner* — Kile O Blair
(74) *Attorney, Agent, or Firm* — Fenwick & West LLP

(57) ABSTRACT

Embodiments herein are primarily described in the context of a system, a method, and a non-transitory computer readable medium for producing a sound with enhanced spatial detectability and reduced crosstalk interference. The audio processing system receives an input audio signal, and performs an audio processing on the input audio signal to generate an output audio signal. In one aspect of the disclosed embodiments, the audio processing system divides the input audio signal into different frequency bands, and enhances a spatial component of the input audio signal with respect to a nonspatial component of the input audio signal for each frequency band.

32 Claims, 17 Drawing Sheets

Related U.S. Application Data

(60) Provisional application No. 62/280,119, filed on Jan. 18, 2016, provisional application No. 62/388,366, filed on Jan. 29, 2016.

(51) Int. Cl.
*G10L 21/0232* (2013.01)
*G10L 21/0208* (2013.01)
*H04R 3/14* (2006.01)

(52) U.S. Cl.
CPC ..... *G10L 2021/02087* (2013.01); *H04R 3/14* (2013.01); *H04R 2430/03* (2013.01); *H04S 2420/07* (2013.01)

(56) References Cited

U.S. PATENT DOCUMENTS

| | | | |
|---|---|---|---|
| 2007/0213990 | A1 | 9/2007 | Moon et al. |
| 2008/0031462 | A1 | 2/2008 | Walsh et al. |
| 2008/0165975 | A1 | 7/2008 | Oh et al. |
| 2008/0249769 | A1 | 10/2008 | Baumgarte |
| 2008/0273721 | A1 | 11/2008 | Walsh |
| 2009/0262947 | A1 | 10/2009 | Karlsson et al. |
| 2009/0304189 | A1 | 12/2009 | Vinton |
| 2011/0152601 | A1 | 6/2011 | Puria et al. |
| 2011/0188660 | A1 | 8/2011 | Xu et al. |
| 2011/0268281 | A1 | 11/2011 | Florencio et al. |
| 2012/0099733 | A1 | 4/2012 | Wang et al. |

FOREIGN PATENT DOCUMENTS

| | | | |
|---|---|---|---|
| CN | 101884065 | B | 7/2013 |
| CN | 103765507 | B | 1/2016 |
| CN | 102893331 | B | 3/2016 |
| GB | 2419265 | A | 4/2006 |
| JP | 2000-050399 | A | 2/2000 |
| JP | 4887420 | B2 | 2/2012 |
| JP | 2013-013042 | A | 1/2013 |
| KR | 10-2009-0074191 | A | 7/2009 |
| KR | 10-2012-0077763 | A | 7/2012 |
| TW | I484484 | | 5/2015 |
| TW | I489447 | | 6/2015 |
| TW | 201532035 | A | 8/2015 |
| WO | WO 2009/022463 | A1 | 2/2009 |

OTHER PUBLICATIONS

PCT International Search Report and Written Opinion, PCT Application No. PCT/US2017/013061, dated Apr. 18, 2017, 12 pages.
PCT International Search Report and Written Opinion, PCT Application No. PCT/US2017/013249, dated Apr. 18, 2017, 20 pages.
"Bark scale," Wikipedia.org, Last Modified Jul. 14, 2016, 4 pages, [Online] [Retrieved on Apr. 20, 2017] Retrieved from the Internet<URL:https://en.wikipedia.org/wiki/Bark_scale>.
Taiwan Office Action, Taiwan Application No. 106101748, dated Aug. 15, 2017, 6 pages (with concise explanation of relevance).
Taiwan Office Action, Taiwan Application No. 106101777, dated Aug. 15, 2017, 6 pages (with concise explanation of relevance).
Korean First Office Action, Korean Application No. 2017-7031417, dated Nov. 30, 2017, 7 pages.
Korean First Office Action, Korean Application No. 2017-7031493, dated Dec. 1, 2017, 6 pages.
Taiwan Office Action, Taiwan Application No. 106138743, dated Mar. 14, 2018, 7 pages.
New Zealand Intellectual Property Office, First Examination Report, NZ Patent Application No. 745415, dated Sep. 14, 2018, four pages.
United States Office Action, U.S. Appl. No. 15/646,821, dated Dec. 6, 2018, 19 pages.

SUBBAND SPATIAL AND CROSSTALK CANCELLATION FOR AUDIO REPRODUCTION

CROSS-REFERENCE TO RELATED APPLICATIONS

This application claims priority under 35 U.S.C. § 119(e) from U.S. Provisional Patent Application No. 62/280,119, entitled "Sub-Band Spatial and Cross-Talk Cancellation Algorithm for Audio Reproduction," filed on Jan. 18, 2016, and U.S. Provisional Patent Application No. 62/388,366, entitled "Sub-Band Spatial and Cross-Talk Cancellation Algorithm for Audio Reproduction," filed on Jan. 29, 2016, all of which are incorporated by reference herein in their entirety. This application is a continuation of copending PCT Patent Application No. PCT/US17/13061, entitled "Subband Spatial and Crosstalk Cancellation For Audio Reproduction," filed on Jan. 11, 2017, which claims the benefit of U.S. Provisional Patent Application No. 62/280,119, entitled "Sub-Band Spatial and Cross-Talk Cancellation Algorithm for Audio Reproduction," filed on Jan. 18, 2016, and U.S. Provisional Patent Application No. 62/388,366, entitled "Sub-Band Spatial and Cross-Talk Cancellation Algorithm for Audio Reproduction," filed on Jan. 29, 2016, all of which are incorporated by reference herein in their entirety.

BACKGROUND

1. Field of the Disclosure

Embodiments of the present disclosure generally relate to the field of audio signal processing and, more particularly, to crosstalk interference reduction and spatial enhancement.

2. Description of the Related Art

Stereophonic sound reproduction involves encoding and reproducing signals containing spatial properties of a sound field. Stereophonic sound enables a listener to perceive a spatial sense in the sound field.

For example, in FIG. 1, two loudspeakers 110A and 110B positioned at fixed locations convert a stereo signal into sound waves, which are directed towards a listener 120 to create an impression of sound heard from various directions. In a conventional near field speaker arrangement such as illustrated in FIG. 1, sound waves produced by both of the loudspeakers 110 are received at both the left and right ears $\mathbf{125}_L$, $\mathbf{125}_R$ of the listener 120 with a slight delay between left ear $\mathbf{125}_L$ and right ear $\mathbf{125}_R$ and filtering caused by the head of the listener 120. Sound waves generated by both speakers create crosstalk interference, which can hinder the listener 120 from determining the perceived spatial location of the imaginary sound source 160.

SUMMARY

An audio processing system adaptively produces two or more output channels for reproduction with enhanced spatial detectability and reduced crosstalk interference based on parameters of the speakers and the listener's position relative to the speakers. The audio processing system applies a two channel input audio signal to multiple audio processing pipelines that adaptively control how a listener perceives the extent of sound field expansion of the audio signal rendered beyond the physical boundaries of the speakers and the location and intensity of sound components within the expanded sound field. The audio processing pipelines include a sound field enhancement processing pipeline and a crosstalk cancellation processing pipeline for processing the two channel input audio signal (e.g., an audio signal for a left channel speaker and an audio signal for a right channel speaker).

In one embodiment, the sound field enhancement processing pipeline preprocesses the input audio signal prior to performing crosstalk cancellation processing to extract spatial and non-spatial components. The preprocessing adjusts the intensity and balance of the energy in the spatial and non-spatial components of the input audio signal. The spatial component corresponds to a non-correlated portion between two channels (a "side component"), while a nonspatial component corresponds to a correlated portion between the two channels (a "mid component"). The sound field enhancement processing pipeline also enables control of the timbral and spectral characteristic of the spatial and non-spatial components of the input audio signal.

In one aspect of the disclosed embodiments, the sound field enhancement processing pipeline performs a subband spatial enhancement on the input audio signal by dividing each channel of the input audio signal into different frequency subbands and extracting the spatial and nonspatial components in each frequency subband. The sound field enhancement processing pipeline then independently adjusts the energy in one or more of the spatial or nonspatial components in each frequency subband, and adjusts the spectral characteristic of one or more of the spatial and non-spatial components. By dividing the input audio signal according to different frequency subbands and by adjusting the energy of a spatial component with respect to a nonspatial component for each frequency subband, the subband spatially enhanced audio signal attains a better spatial localization when reproduced by the speakers. Adjusting the energy of the spatial component with respect to the nonspatial component may be performed by adjusting the spatial component by a first gain coefficient, the nonspatial component by a second gain coefficient, or both.

In one aspect of the disclosed embodiments, the crosstalk cancellation processing pipeline performs crosstalk cancellation on the subband spatially enhanced audio signal output from the sound field processing pipeline. A signal component (e.g., 118L, 118R) output by a speaker on the same side of the listener's head and received by the listener's ear on that side is herein referred to as "an ipsilateral sound component" (e.g., left channel signal component received at left ear, and right channel signal component received at right ear) and a signal component (e.g., 112L, 112R) output by a speaker on the opposite side of the listener's head is herein referred to as "a contralateral sound component" (e.g., left channel signal component received at right ear, and right channel signal component received at left ear). Contralateral sound components contribute to crosstalk interference, which results in diminished perception of spatiality. The crosstalk cancellation processing pipeline predicts the contralateral sound components and identifies signal components of the input audio signal contributing to the contralateral sound components. The crosstalk cancellation processing pipeline then modifies each channel of the subband spatially enhanced audio signal by adding an inverse of the identified signal components of a channel to the other channel of the subband spatially enhanced audio signal to generate an output audio signal for reproducing sound. As a result, the disclosed system can reduce the contralateral sound components that contribute to crosstalk interference, and improve the perceived spatiality of the output sound.

In one aspect of the disclosed embodiments, an output audio signal is obtained by adaptively processing the input audio signal through the sound field enhancement processing pipeline and subsequently processing through the crosstalk cancellation processing pipeline, according to parameters for speakers' position relative to the listeners. Examples of the parameters of the speakers include a distance between the listener and a speaker, an angle formed by two speakers with respect to the listener. Additional parameters include the frequency response of the speakers, and may include other parameters that can be measured in real time, prior to, or during the pipeline processing. The crosstalk cancellation process is performed using the parameters. For example, a cut-off frequency, delay, and gain associated with the crosstalk cancellation can be determined as a function of the parameters of the speakers. Furthermore, any spectral defects due to the corresponding crosstalk cancellation associated with the parameters of the speakers can be estimated. Moreover, a corresponding crosstalk compensation to compensate for the estimated spectral defects can be performed for one or more subbands through the sound field enhancement processing pipeline.

Accordingly, the sound field enhancement processing, such as the subband spatial enhancement processing and the crosstalk compensation, improves the overall perceived effectiveness of a subsequent crosstalk cancellation processing. As a result, the listener can perceive that the sound is directed to the listener from a large area rather than specific points in space corresponding to the locations of the speakers, and thereby producing a more immersive listening experience to the listener.

DETAILED DESCRIPTION

The features and advantages described in the specification are not all inclusive and, in particular, many additional features and advantages will be apparent to one of ordinary skill in the art in view of the drawings, specification, and claims. Moreover, it should be noted that the language used in the specification has been principally selected for readability and instructional purposes, and may not have been selected to delineate or circumscribe the inventive subject matter.

The Figures (FIG.) and the following description relate to the preferred embodiments by way of illustration only. It should be noted that from the following discussion, alternative embodiments of the structures and methods disclosed herein will be readily recognized as viable alternatives that may be employed without departing from the principles of the present invention.

Reference will now be made in detail to several embodiments of the present invention(s), examples of which are illustrated in the accompanying figures. It is noted that wherever practicable similar or like reference numbers may be used in the figures and may indicate similar or like functionality. The figures depict embodiments for purposes of illustration only. One skilled in the art will readily recognize from the following description that alternative embodiments of the structures and methods illustrated herein may be employed without departing from the principles described herein.

Example Audio Processing System

Figure 1:
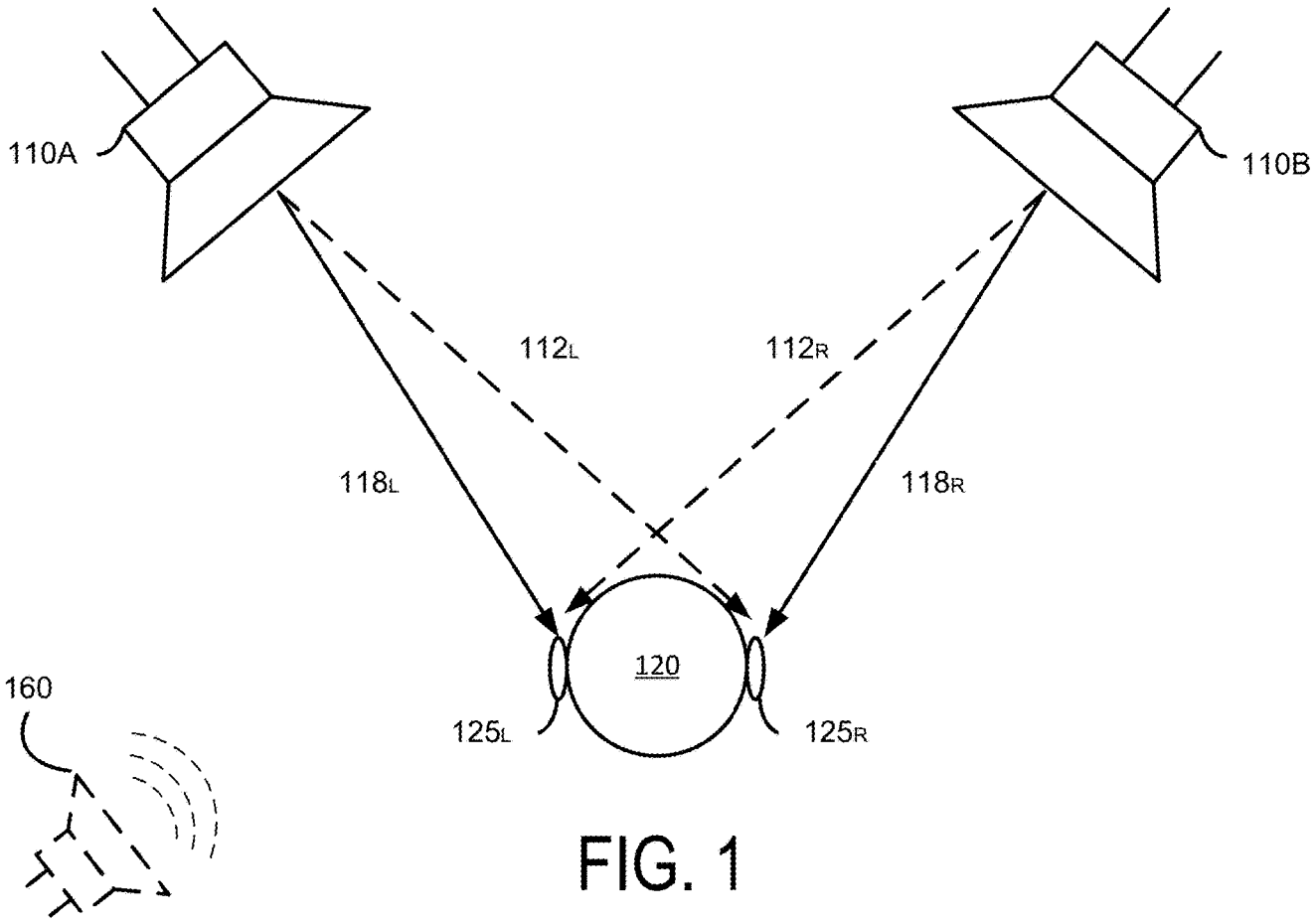
FIG. 1 (Related Art)
FIG. 1 illustrates a related art stereo audio reproduction system.
Figure 2A:
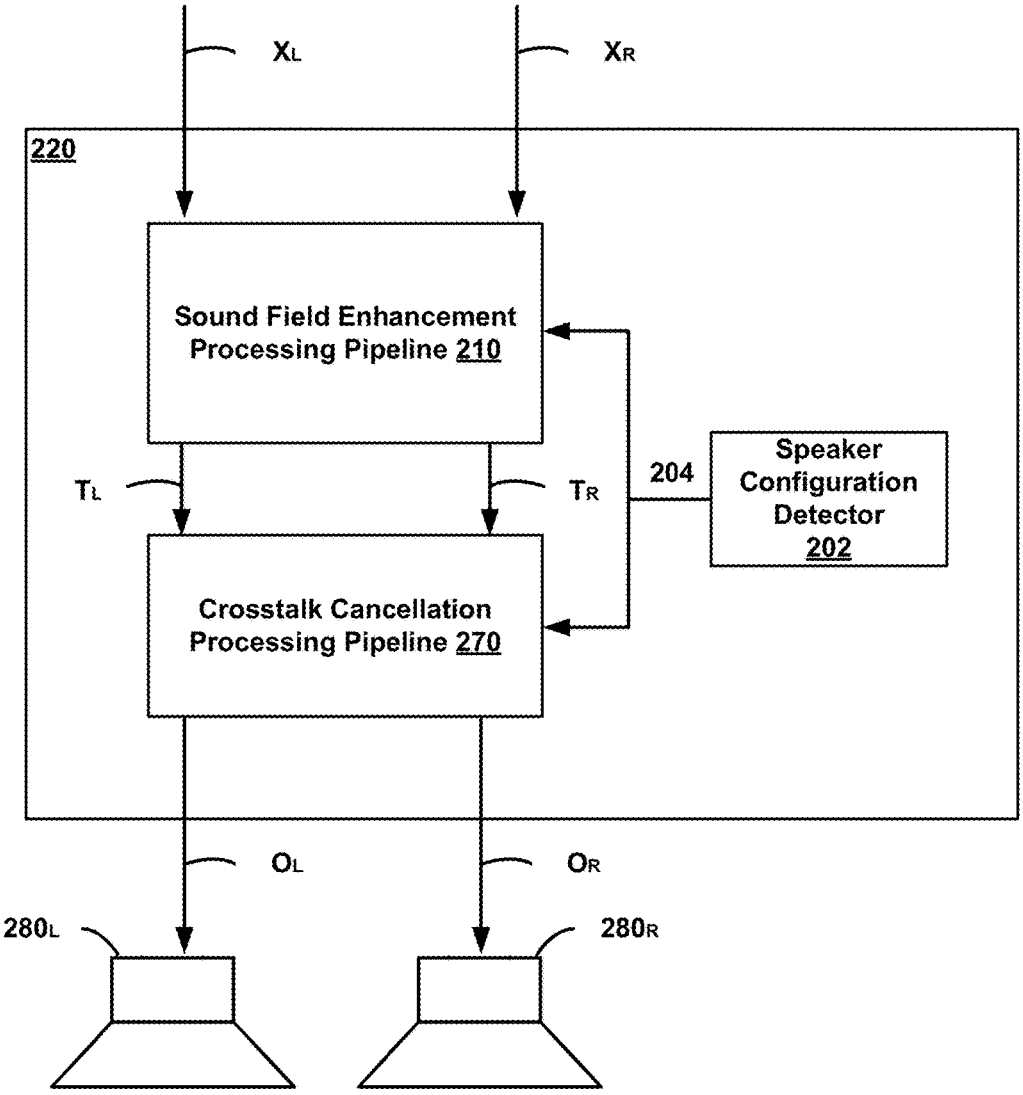
FIG. 2A illustrates an example of an audio processing system for reproducing an enhanced sound field with reduced crosstalk interference, according to one embodiment.

FIG. 2A illustrates an example of an audio processing system 220 for reproducing an enhanced spatial field with reduced crosstalk interference, according to one embodiment. The audio processing system 220 receives an input audio signal X comprising two input channels $X_L$, $X_R$. The audio processing system 220 predicts, in each input channel, signal components that will result in contralateral signal components. In one aspect, the audio processing system 220 obtains information describing parameters of speakers $\mathbf{280}_L$, $\mathbf{280}_R$, and estimates the signal components that will result in the contralateral signal components according to the information describing parameters of the speakers. The audio processing system 220 generates an output audio signal O comprising two output channels $O_L$, $O_R$ by adding, for each channel, an inverse of a signal component that will result in the contralateral signal component to the other channel, to remove the estimated contralateral signal components from each input channel. Moreover, the audio processing system 220 may couple the output channels $O_L$, $O_R$ to output devices, such as loudspeakers $\mathbf{280}_L$, $\mathbf{280}_R$.

In one embodiment, the audio processing system 220 includes a sound field enhancement processing pipeline 210, a crosstalk cancellation processing pipeline 270, and a speaker configuration detector 202. The components of the audio processing system 220 may be implemented in electronic circuits. For example, a hardware component may comprise dedicated circuitry or logic that is configured (e.g., as a special purpose processor, such as a digital signal processor (DSP), field programmable gate array (FPGA) or an application specific integrated circuit (ASIC)) to perform certain operations disclosed herein.

The speaker configuration detector 202 determines parameters 204 of the speakers 280. Examples of parameters of the speakers include a number of speakers, a distance between the listener and a speaker, the subtended listening angle formed by two speakers with respect to the listener ("speaker angle"), output frequency of the speakers, cutoff frequencies, and other quantities that can be predefined or measured in real time. The speaker configuration detector 202 may obtain information describing a type (e.g., built in speaker in phone, built in speaker of a personal computer, a portable speaker, boom box, etc.) from a user input or system input (e.g., headphone jack detection event), and determine the parameters of the speakers according to the type or the model of the speakers 280. Alternatively, the speaker configuration detector 202 can output test signals to each of the speakers 280 and use a built in microphone (not shown) to sample the speaker outputs. From each sampled output, the speaker configuration detector 202 can determine the speaker distance and response characteristics. Speaker angle can be provided by the user (e.g., the listener 120 or another person) either by selection of an angle amount, or based on the speaker type. Alternatively or additional, the speaker angle can be determined through interpreted captured user or system-generated sensor data, such as microphone signal analysis, computer vision analysis of an image taken of the speakers (e.g., using the focal distance to estimate intra-speaker distance, and then the arc-tan of the ratio of one-half of the intra-speaker distance to focal distance to obtain the half-speaker angle), system-integrated gyroscope or accelerometer data. The sound field enhancement processing pipeline 210 receives the input audio signal X, and performs sound field enhancement on the input audio signal X to generate a precompensated signal comprising channels $T_L$ and $T_R$. The sound field enhancement processing pipeline 210 performs sound field enhancement using a subband spatial enhancement, and may use the parameters 204 of the speakers 280. In particular, the sound field enhancement processing pipeline 210 adaptively performs (i) subband spatial enhancement on the input audio signal X to enhance spatial information of input audio signal X for one or more frequency subbands, and (ii) performs crosstalk compensation to compensate for any spectral defects due to the subsequent crosstalk cancellation by the crosstalk cancellation processing pipeline 270 according to the parameters of the speakers 280. Detailed implementations and operations of the sound field enhancement processing pipeline 210 are provided with respect to FIGS. 2B, 3-7 below.

The crosstalk cancellation processing pipeline 270 receives the precompensated signal T, and performs a crosstalk cancellation on the precompensated signal T to generate the output signal O. The crosstalk cancellation processing pipeline 270 may adaptively perform crosstalk cancellation according to the parameters 204. Detailed implementations and operations of the crosstalk cancellation processing pipeline 270 are provided with respect to FIGS. 3, and 8-9 below.

In one embodiment, configurations (e.g., center or cutoff frequencies, quality factor (Q), gain, delay, etc.) of the sound field enhancement processing pipeline 210 and the crosstalk cancellation processing pipeline 270 are determined according to the parameters 204 of the speakers 280. In one aspect, different configurations of the sound field enhancement processing pipeline 210 and the crosstalk cancellation processing pipeline 270 may be stored as one or more look up tables, which can be accessed according to the speaker parameters 204. Configurations based on the speaker parameters 204 can be identified through the one or more look up tables, and applied for performing the sound field enhancement and the crosstalk cancellation.

In one embodiment, configurations of the sound field enhancement processing pipeline 210 may be identified through a first look up table describing an association between the speaker parameters 204 and corresponding configurations of the sound field enhancement processing pipeline 210. For example, if the speaker parameters 204 specify a listening angle (or range) and further specify a type of speakers (or a frequency response range (e.g., 350 Hz and 12 kHz for portable speakers), configurations of the sound field enhancement processing pipeline 210 may be determined through the first look up table. The first look up table may be generated by simulating spectral artifacts of the crosstalk cancellation under various settings (e.g., varying cut off frequencies, gain or delay for performing crosstalk cancellation), and predetermining settings of the sound field enhancement to compensate for the corresponding spectral artifacts. Moreover, the speaker parameters 204 can be mapped to configurations of the sound field enhancement processing pipeline 210 according to the crosstalk cancellation. For example, configurations of the sound field enhancements processing pipeline 210 to correct spectral artifacts of a particular crosstalk cancellation may be stored in the first look up table for the speakers 280 associated with the crosstalk cancellation.

In one embodiment, configurations of the crosstalk cancellation processing pipeline 270 are identified through a second look up table describing an association between various speaker parameters 204 and corresponding configurations (e.g., cut off frequency, center frequency, Q, gain, and delay) of the crosstalk cancellation processing pipeline 270. For example, if the speakers 280 of a particular type (e.g., portable speaker) are arranged in a particular angle, configurations of the crosstalk cancellation processing pipeline 270 for performing crosstalk cancellation for the speakers 280 may be determined through the second look up table. The second look up table may be generated through empirical experiments by testing sound generated under various settings (e.g., distance, angle, etc.) of various speakers 280.

Figure 2B:
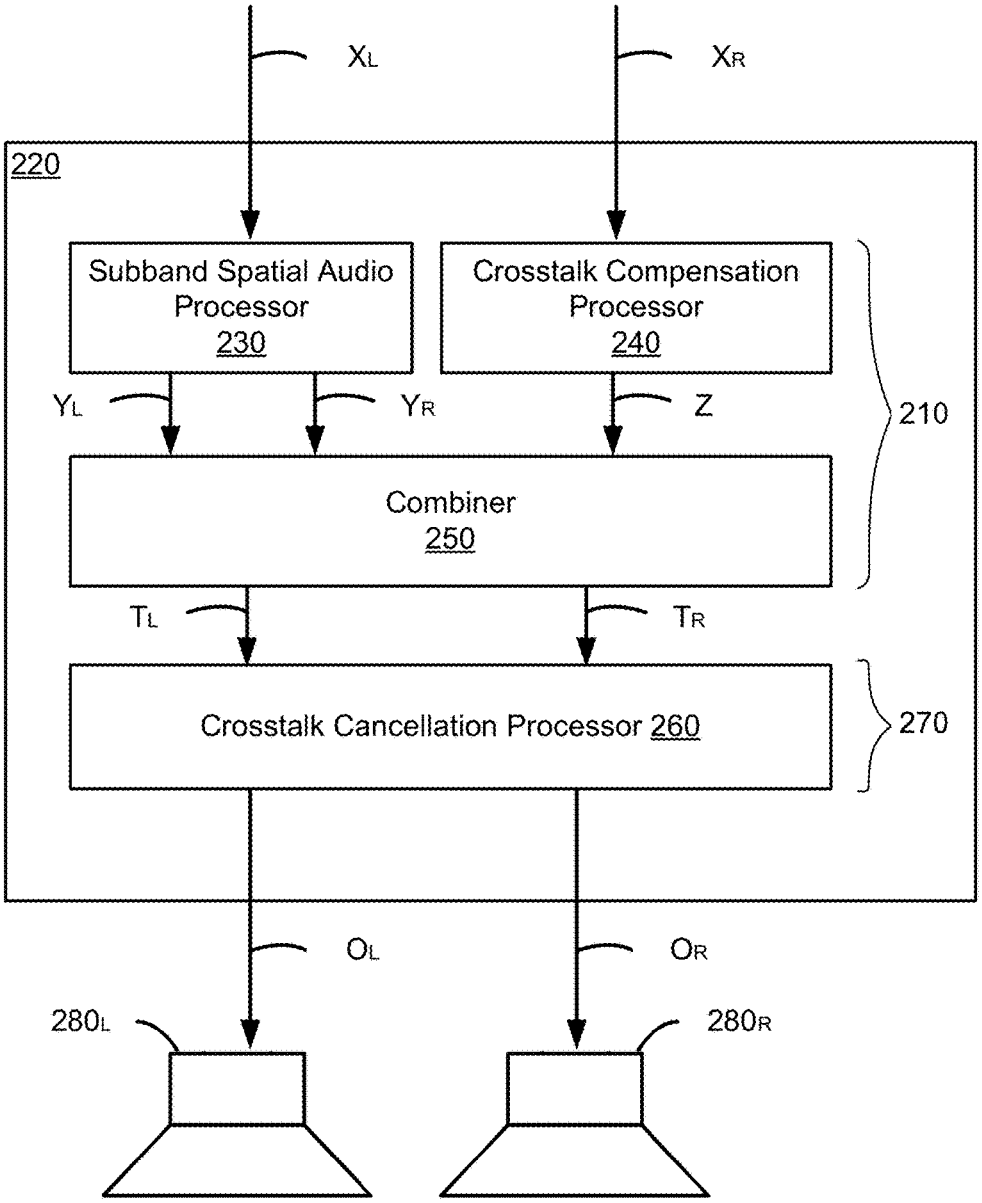
FIG. 2B illustrates a detailed implementation of the audio processing system shown in FIG. 2A, according to one embodiment.

FIG. 2B illustrates a detailed implementation of the audio processing system 220 shown in FIG. 2A, according to one embodiment. In one embodiment, the sound field enhancement processing pipeline 210 includes a subband spatial (SBS) audio processor 230, a crosstalk compensation processor 240, and a combiner 250, and the crosstalk cancellation processing pipeline 270 includes a crosstalk cancellation (CTC) processor 260. (The speaker configuration detector 202 is not shown in this figure.) In some embodiments, the crosstalk compensation processor 240 and the combiner 250 may be omitted, or integrated with the SBS audio processor 230. The SBS audio processor 230 generates a spatially enhanced audio signal Y comprising two channels, such as left channel $Y_L$ and right channel $Y_R$.

Figure 3:
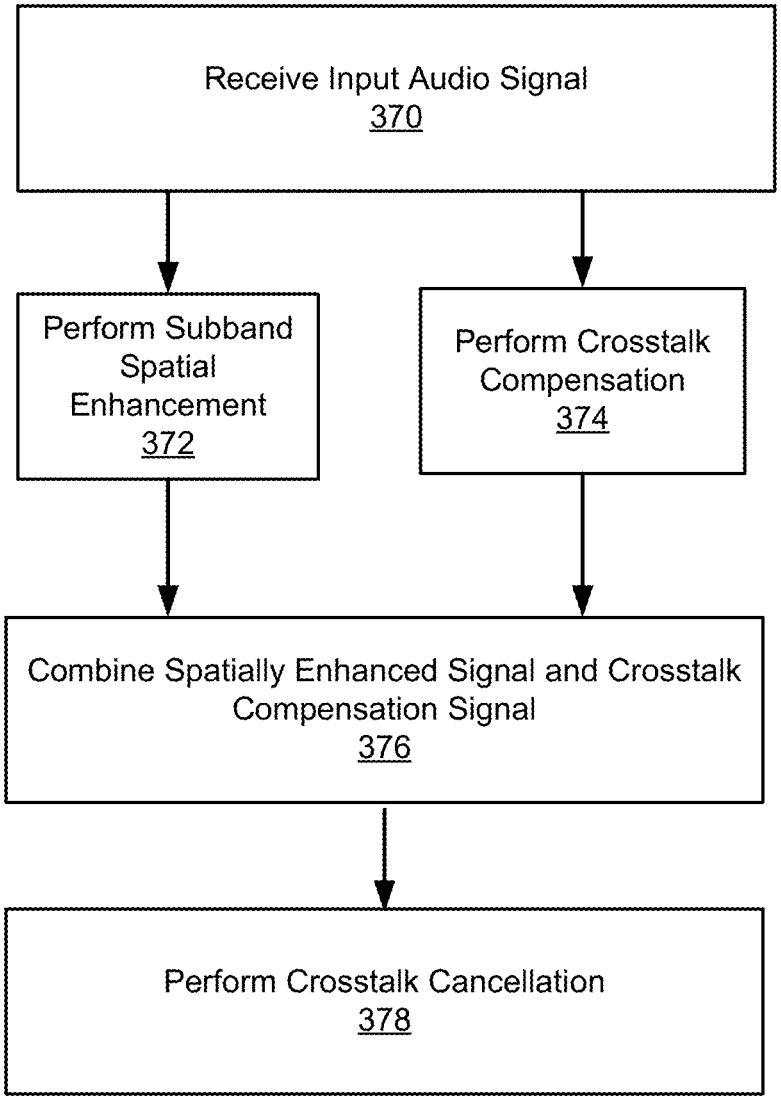
FIG. 3 illustrates an example signal processing algorithm for processing an audio signal to reduce crosstalk interference, according to one embodiment.

FIG. 3 illustrates an example signal processing algorithm for processing an audio signal to reduce crosstalk interference, as would be performed by the audio processing system 220 according to one embodiment. In some embodiments, the audio processing system 220 may perform the steps in parallel, perform the steps in different orders, or perform different steps.

The subband spatial audio processor 230 receives 370 the input audio signal X comprising two channels, such as left channel $X_L$ and right channel $X_R$, and performs 372 a subband spatial enhancement on the input audio signal X to generate a spatially enhanced audio signal Y comprising two channels, such as left channel $Y_L$ and right channel $Y_R$. In one embodiment, the subband spatial enhancement includes applying the left channel $Y_L$ and right channel $Y_R$ to a crossover network that divides each channel of the input audio signal X into different input subband signals X(k). The crossover network comprises multiple filters arranged in various circuit topologies as discussed with reference to the frequency band divider 410 shown in FIG. 4. The output of the crossover network is matrixed into mid and side components. Gains are applied to the mid and side components to adjust the balance or ratio between the mid and side components of the each subband. The respective gains and delay applied to the mid and side subband components may be determined according to a first look up table, or a function. Thus, the energy in each spatial subband component $X_s(k)$ of an input subband signal X(k) is adjusted with respect to the energy in each nonspatial subband component $X_n(k)$ of the input subband signal X(k) to generate an enhanced spatial subband component $Y_s(k)$, and an enhanced nonspatial subband component $Y_n$ (k) for a subband k. Based on the enhanced subband components $Y_s(k)$, $Y_n$ (k), the subband spatial audio processor 230 performs a de-matrix operation to generate two channels (e.g., left channel $Y_L(k)$ and right channel $Y_R(k)$) of a spatially enhanced subband audio signal Y(k) for a subband k. The subband spatial audio processor applies a spatial gain to the two de-matrixed channels to adjust the energy. Furthermore, the subband spatial audio processor 230 combines spatially enhanced subband audio signals Y(k) in each channel to generate a corresponding channel $Y_L$ and $Y_R$ of the spatially enhanced audio signal Y. Details of frequency division and subband spatial enhancement are described below with respect to FIG. 4.

The crosstalk compensation processor 240 performs 374 a crosstalk compensation to compensate for artifacts resulting from a crosstalk cancellation. These artifacts, resulting primarily from the summation of the delayed and inverted contralateral sound components with their corresponding ipsilateral sound components in the crosstalk cancellation processor 260, introduce a comb filter-like frequency response to the final rendered result. Based on the specific delay, amplification, or filtering applied in the crosstalk cancellation processor 260, the amount and characteristics (e.g., center frequency, gain, and Q) of sub-Nyquist comb filter peaks and troughs shift up and down in the frequency response, causing variable amplification and/or attenuation of energy in specific regions of the spectrum. The crosstalk compensation may be performed as a preprocessing step by delaying or amplifying, for a given parameter of the speakers 280, the input audio signal X for a particular frequency band, prior to the crosstalk cancellation performed by the crosstalk cancellation processor 260. In one implementation, the crosstalk compensation is performed on the input audio signal X to generate a crosstalk compensation signal Z in parallel with the subband spatial enhancement performed by the subband spatial audio processor 230. In this implementation, the combiner 250 combines 376 the crosstalk compensation signal Z with each of two channels $Y_L$ and $Y_R$ to generate a precompensated signal T comprising two precompensated channels $T_L$ and $T_R$. Alternatively, the crosstalk compensation is performed sequentially after the subband spatial enhancement, after the crosstalk cancellation, or integrated with the subband spatial enhancement. Details of the crosstalk compensation are described below with respect to FIG. 6.

The crosstalk cancellation processor 260 performs 378 a crosstalk cancellation to generate output channels $O_L$ and $O_R$. More particularly, the crosstalk cancellation processor 260 receives the precompensated channels $T_L$ and $T_R$ from the combiner 250, and performs a crosstalk cancellation on the precompensated channels $T_L$ and $T_R$ to generate the output channels $O_L$ and $O_R$. For a channel (L/R), the crosstalk cancellation processor 260 estimates a contralateral sound component due to the precompensated channel $T_{(L/R)}$ and identifies a portion of the precompensated channel $T_{(L/R)}$ contributing to the contralateral sound component according the speaker parameters 204. The crosstalk cancellation processor 260 adds an inverse of the identified portion of the precompensated channel $T_{(L/R)}$ to the other precompensated channel $T_{(R/L)}$ to generate the output channel $O_{(R/L)}$. In this configuration, a wavefront of an ipsilateral sound component output by the speaker $\mathbf{280}_{(R/L)}$ according to the output channel $O_{(R/L)}$ arrived at an ear $\mathbf{125}_{(R/L)}$ can cancel a wavefront of a contralateral sound component output by the other speaker $\mathbf{280}_{(L/R)}$ according to the output channel $O_{(L/R)}$, thereby effectively removing the contralateral sound component due to the output channel $O_{(L/R)}$. Alternatively, the crosstalk cancellation processor 260 may perform the crosstalk cancellation on the spatially enhanced audio signal Y from the subband spatial audio processor 230 or on the input audio signal X instead. Details of the crosstalk cancellation are described below with respect to FIG. 8.

Figure 4:
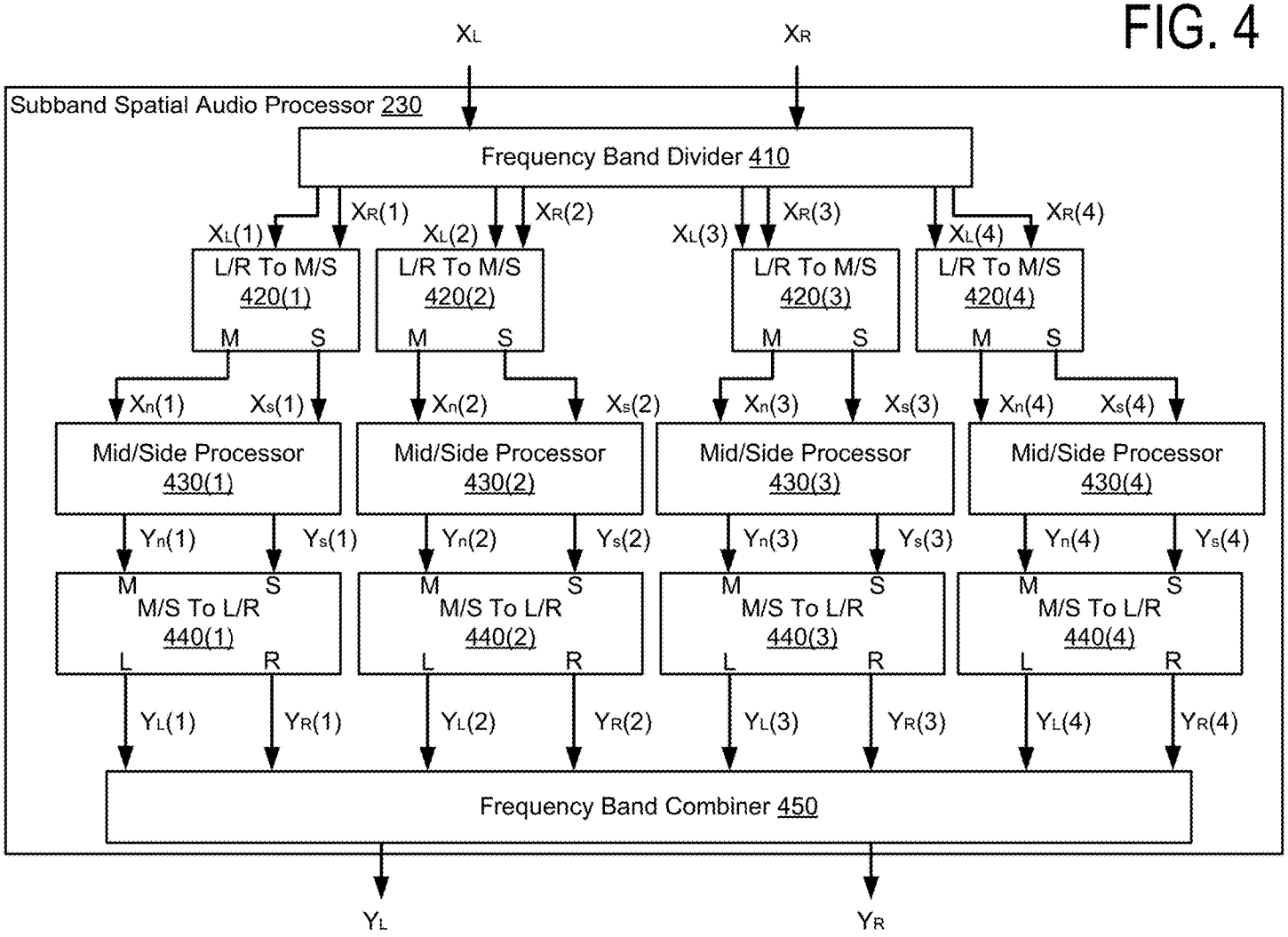
FIG. 4 illustrates an example diagram of a subband spatial audio processor, according to one embodiment.

FIG. 4 illustrates an example diagram of a subband spatial audio processor 230, according to one embodiment that employs a mid/side processing approach. The subband spatial audio processor 230 receives the input audio signal comprising channels $X_L$, $X_R$, and performs a subband spatial enhancement on the input audio signal to generate a spatially enhanced audio signal comprising channels $Y_L$, $Y_R$. In one embodiment, the subband spatial audio processor 230 includes a frequency band divider 410, left/right audio to mid/side audio converters 420(*k*) ("a L/R to M/S converter 420(*k*)"), mid/side audio processors 430(*k*) ("a mid/side processor 430(*k*)" or "a subband processor 430(*k*)"), mid/side audio to left/right audio converters 440(*k*) ("a M/S to L/R converter 440(*k*)" or "a reverse converter 440(*k*)") for a group of frequency subbands k, and a frequency band combiner 450. In some embodiments, the components of the subband spatial audio processor 230 shown in FIG. 4 may be arranged in different orders. In some embodiments, the subband spatial audio processor 230 includes different, additional or fewer components than shown in FIG. 4.

In one configuration, the frequency band divider 410, or filterbank, is a crossover network that includes multiple filters arranged in any of various circuit topologies, such as serial, parallel, or derived. Example filter types included in the crossover network include infinite impulse response (IIR) or finite impulse response (FIR) bandpass filters, BR peaking and shelving filters, Linkwitz-Riley, or other filter types known to those of ordinary skill in the audio signal processing art. The filters divide the left input channel $X_L$ into left subband components $X_L(k)$, and divide the right input channel $X_R$ into right subband components $X_R(k)$ for each frequency subband k. In one approach, four bandpass filters, or any combinations of low pass filter, bandpass filter, and a high pass filter, are employed to approximate the critical bands of the human ear. A critical band corresponds to the bandwidth of within which a second tone is able to mask an existing primary tone. For example, each of the frequency subbands may correspond to a consolidated Bark scale to mimic critical bands of human hearing. For example, the frequency band divider 410 divides the left input channel $X_L$ into the four left subband components $X_L(k)$, corresponding to 0 to 300 Hz, 300 to 510 Hz, 510 to 2700 Hz, and 2700 to Nyquist frequency respectively, and similarly divides the right input channel $X_R$ into the right subband components $X_R(k)$ for corresponding frequency bands. The process of determining a consolidated set of critical bands includes using a corpus of audio samples from a wide variety of musical genres, and determining from the samples a long term average energy ratio of mid to side components over the 24 Bark scale critical bands. Contiguous frequency bands with similar long term average ratios are then grouped together to form the set of critical bands. In other implementations, the filters separate the left and right input channels into fewer or greater than four subbands. The range of frequency bands may be adjustable. The frequency band divider 410 outputs a pair of a left subband component $X_L(k)$ and a right subband component $X_R(k)$ to a corresponding L/R to M/S converter 420(*k*).

A L/R to M/S converter 420(*k*), a mid/side processor 430(*k*), and a M/S to L/R converter 440(*k*) in each frequency subband k operate together to enhance a spatial subband component $X_s(k)$ (also referred to as "a side subband component") with respect to a nonspatial subband component $X_n(k)$ (also referred to as "a mid subband component") in its respective frequency subband k. Specifically, each L/R to M/S converter 420(*k*) receives a pair of subband components $X_L(k)$, $X_R(k)$ for a given frequency subband k, and converts these inputs into a mid subband component and a side subband component. In one embodiment, the nonspatial subband component $X_n(k)$ corresponds to a correlated portion between the left subband component $X_L(k)$ and the right subband component $X_R(k)$, hence, includes nonspatial information. Moreover, the spatial subband component $X_s(k)$ corresponds to a non-correlated portion between the left subband component $X_L(k)$ and the right subband component $X_R(k)$, hence includes spatial information. The nonspatial subband component $X_n$ (k) may be computed as a sum of the left subband component $X_L(k)$ and the right subband component $X_R(k)$, and the spatial subband component $X_s(k)$ may be computed as a difference between the left subband component $X_L(k)$ and the right subband component $X_R(k)$. In one example, the L/R to M/S converter 420 obtains the spatial subband component $X_s(k)$ and nonspatial subband component $X_n$ (k) of the frequency band according to a following equations:

$$X_s(k)=X_L(k)-X_R(k) \text{ for subband } k \quad \text{Eq. (1)}$$

$$X_n(k)=X_L(k)+X_R(k) \text{ for subband } k \quad \text{Eq. (2)}$$

Each mid/side processor 430(*k*) enhances the received spatial subband component $X_s(k)$ with respect to the received nonspatial subband component $X_n$ (k) to generate an enhanced spatial subband component $Y_s(k)$ and an enhanced nonspatial subband component $Y_n$ (k) for a subband k. In one embodiment, the mid/side processor 430(*k*) adjusts the nonspatial subband component $X_n$ (k) by a corresponding gain coefficient $G_n$ (k), and delays the amplified nonspatial subband component $G_n$ (k)*$X_n$ (k) by a corresponding delay function D[ ] to generate an enhanced nonspatial subband component $Y_n$ (k). Similarly, the mid/side processor 430(*k*) adjusts the received spatial subband component $X_s(k)$ by a corresponding gain coefficient $G_s(k)$, and delays the amplified spatial subband component $G_s(k)$ *$X_s(k)$ by a corresponding delay function D to generate an enhanced spatial subband component $Y_s(k)$. The gain coefficients and the delay amount may be adjustable. The gain coefficients and the delay amount may be determined according to the speaker parameters 204 or may be fixed for an assumed set of parameter values. Each mid/side processor 430(*k*) outputs the nonspatial subband component $X_n$ (k) and the spatial subband component $X_s(k)$ to a corresponding M/S to L/R converter 440(*k*) of the respective frequency subband k. The mid/side processor 430(*k*) of a frequency subband k generates an enhanced non-spatial subband component $Y_n$ (k) and an enhanced spatial subband component $Y_s(k)$ according to following equations:

$$Y_n(k)=G_n(k)*D[X_n(k),k] \text{ for subband } k \quad \text{Eq. (3)}$$

$$Y_s(k)=G_s(k)*D[X_s(k),k] \text{ for subband } k \quad \text{Eq. (4)}$$

Examples of gain and delay coefficients are listed in the following Table 1.

TABLE 1

Example configurations of mid/side processors.

| | Subband 1 (0-300 Hz) | Subband 2 (300-510 Hz) | Subband 3 (510-2700 Hz) | Subband 4 (2700-24000 Hz) |
|---|---|---|---|---|
| $G_n$ (dB) | −1 | 0 | 0 | 0 |
| $G_s$ (dB) | 2 | 7.5 | 6 | 5.5 |
| $D_n$ (samples) | 0 | 0 | 0 | 0 |
| $D_s$ (samples) | 5 | 5 | 5 | 5 |

Each M/S to L/R converter 440(*k*) receives an enhanced nonspatial component $Y_n(k)$ and an enhanced spatial component $Y_s(k)$, and converts them into an enhanced left subband component $Y_L(k)$ and an enhanced right subband component $Y_R(k)$. Assuming that a L/R to M/S converter 420(*k*) generates the nonspatial subband component $X_n$ (k) and the spatial subband component $X_s(k)$ according to Eq. (1) and Eq. (2) above, the M/S to L/R converter 440(*k*) generates the enhanced left subband component $Y_L(k)$ and the enhanced right subband component $Y_R(k)$ of the frequency subband k according to following equations:

$$Y_L(k)=(Y_n(k)+Y_s(k))/2 \text{ for subband } k \quad \text{Eq. (5)}$$

$$Y_R(k)=(Y_n(k)-Y_s(k))/2 \text{ for subband } k \quad \text{Eq. (6)}$$

In one embodiment, $X_L(k)$ and $X_R(k)$ in Eq. (1) and Eq. (2) may be swapped, in which case $Y_L(k)$ and $Y_R(k)$ in Eq. (5) and Eq. (6) are swapped as well.

The frequency band combiner 450 combines the enhanced left subband components in different frequency bands from the M/S to L/R converters 440 to generate the left spatially enhanced audio channel $Y_L$ and combines the enhanced right subband components in different frequency bands from the M/S to L/R converters 440 to generate the right spatially enhanced audio channel $Y_R$, according to following equations:

$$Y_L=\Sigma Y_L(k) \quad \text{Eq. (7)}$$

$$Y_R=\Sigma Y_R(k) \quad \text{Eq. (8)}$$

Although in the embodiment of FIG. 4 the input channels $X_L$, $X_R$ are divided into four frequency subbands, in other embodiments, the input channels $X_L$, $X_R$ can be divided into a different number of frequency subbands, as explained above.

Figure 5:
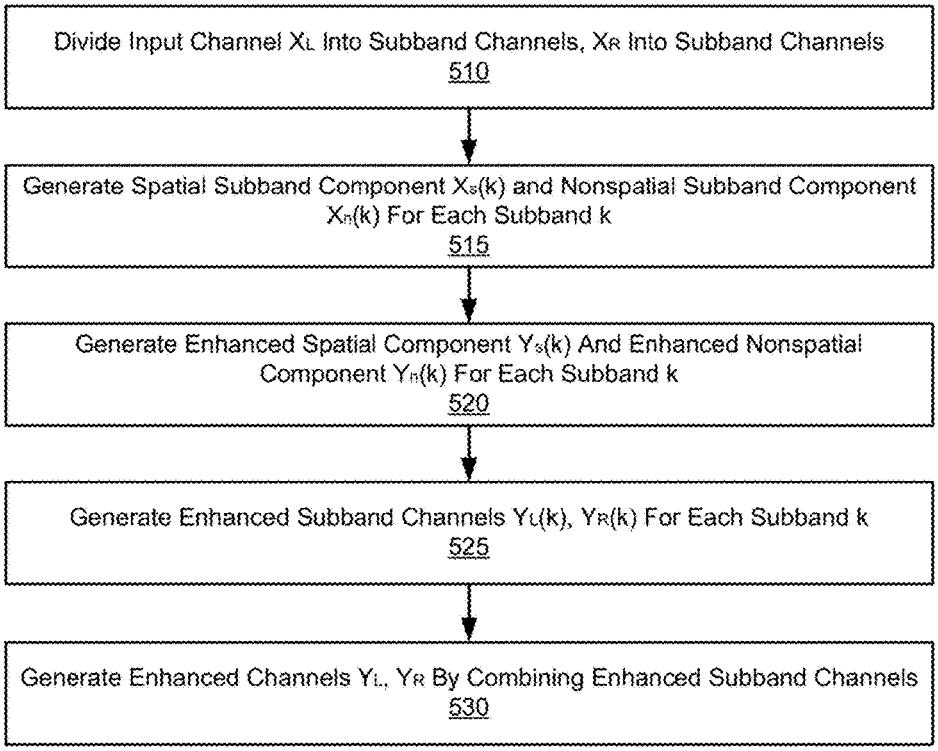
FIG. 5 illustrates an example algorithm for performing subband spatial enhancement, according to one embodiment.

FIG. 5 illustrates an example algorithm for performing subband spatial enhancement, as would be performed by the subband spatial audio processor 230 according to one embodiment. In some embodiments, the subband spatial audio processor 230 may perform the steps in parallel, perform the steps in different orders, or perform different steps.

The subband spatial audio processor 230 receives an input signal comprising input channels $X_L$, $X_R$. The subband spatial audio processor 230 divides 510 the input channel $X_L$ into $X_L(k)$ (e.g., k=4) subband components, e.g., $X_L(1)$, $X_L(2)$, $X_L(3)$ $X_L(4)$, and the input channel $X_R(k)$ into subband components, e.g., $X_R(1)$, $X_R(2)$, $X_R(3)$ $X_R(4)$ according to k frequency subbands, e.g., subband encompassing 0 to 300 Hz, 300 to 510 Hz, 510 to 2700 Hz, and 2700 to Nyquist frequency, respectively.

The subband spatial audio processor 230 performs subband spatial enhancement on the subband components for each frequency subband k. Specifically, the subband spatial audio processor 230 generates 515, for each subband k, a spatial subband component $X_s(k)$ and a nonspatial subband component $X_n$ (k) based on subband components $X_L(k)$, $X_R(k)$, for example, according to Eq. (1) and Eq. (2) above. In addition, the subband spatial audio processor 230 generates 520, for the subband k, an enhanced spatial component $Y_s(k)$ and an enhanced nonspatial component $Y_n(k)$ based on the spatial subband component $X_s(k)$ and nonspatial subband component $X_n$ (k), for example, according to Eq. (3) and Eq. (4) above. Moreover, the subband spatial audio processor 230 generates 525, for the subband k, enhanced subband components $Y_L(k)$, $Y_R(k)$ based on the enhanced spatial component $Y_s(k)$ and the enhanced nonspatial component $Y_n$ (k), for example, according to Eq. (5) and Eq. (6) above.

The subband spatial audio processor 230 generates 530 a spatially enhanced channel $Y_L$ by combining all enhanced subband components $Y_L(k)$ and generates a spatially enhanced channel $Y_R$ by combining all enhanced subband components $Y_R(k)$.

Figure 6:
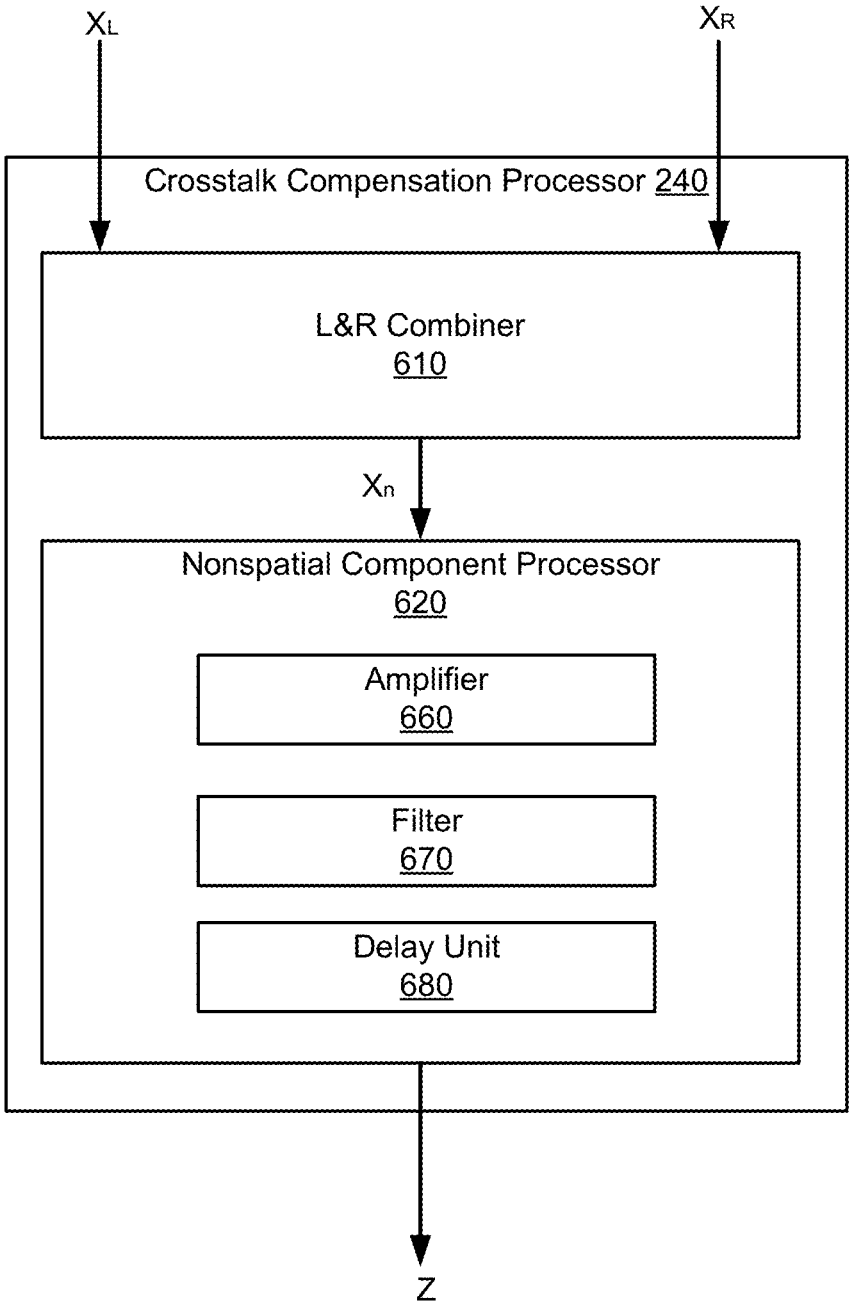
FIG. 6 illustrates an example diagram of a crosstalk compensation processor, according to one embodiment.

FIG. 6 illustrates an example diagram of a crosstalk compensation processor 240, according to one embodiment. The crosstalk compensation processor 240 receives the input channels $X_L$ and $X_R$, and performs a preprocessing to precompensate for any artifacts in a subsequent crosstalk cancellation performed by the crosstalk cancellation processor 260. In one embodiment, the crosstalk compensation processor 240 includes a left and right signals combiner 610 (also referred to as "an L&R combiner 610"), and a nonspatial component processor 620.

The L&R combiner 610 receives the left input audio channel $X_L$ and the right input audio channel $X_R$, and generates a nonspatial component $X_n$ of the input channels $X_L$, $X_R$. In one aspect of the disclosed embodiments, the nonspatial component $X_n$ corresponds to a correlated portion between the left input channel $X_L$ and the right input channel $X_R$. The L&R combiner 610 may add the left input channel $X_L$ and the right input channel $X_R$ to generate the correlated portion, which corresponds to the nonspatial component $X_n$ of the input audio channels $X_L$, $X_R$ as shown in the following equation:

$$X_n = X_L + X_R \quad \text{Eq. (9)}$$

The nonspatial component processor 620 receives the nonspatial component $X_n$, and performs the nonspatial enhancement on the nonspatial component $X_n$ to generate the crosstalk compensation signal Z. In one aspect of the disclosed embodiments, the nonspatial component processor 620 performs a preprocessing on the nonspatial component $X_n$ of the input channels $X_L$, $X_R$ to compensate for any artifacts in a subsequent crosstalk cancellation. A frequency response plot of the nonspatial signal component of a subsequent crosstalk cancellation can be obtained through simulation. In addition, by analyzing the frequency response plot, any spectral defects such as peaks or troughs in the frequency response plot over a predetermined threshold (e.g., 10 dB) occurring as an artifact of the crosstalk cancellation can be estimated. These artifacts result primarily from the summation of the delayed and inverted contralateral signals with their corresponding ipsilateral signal in the crosstalk cancellation processor 260, thereby effectively introducing a comb filter-like frequency response to the final rendered result. The crosstalk compensation signal Z can be generated by the nonspatial component processor 620 to compensate for the estimated peaks or troughs. Specifically, based on the specific delay, filtering frequency, and gain applied in the crosstalk cancellation processor 260, peaks and troughs shift up and down in the frequency response, causing variable amplification and/or attenuation of energy in specific regions of the spectrum.

In one implementation, the nonspatial component processor 620 includes an amplifier 660, a filter 670 and a delay unit 680 to generate the crosstalk compensation signal Z to compensate for the estimated spectral defects of the crosstalk cancellation. In one example implementation, the amplifier 660 amplifies the nonspatial component $X_n$ by a gain coefficient $G_n$ and the filter 670 performs a $2^{nd}$ order peaking EQ filter F[ ] on the amplified nonspatial component $G_n * X_n$. Output of the filter 670 may be delayed by the delay unit 680 by a delay function D. The filter, amplifier, and the delay unit may be arranged in cascade in any sequence. The filter, amplifier, and the delay unit may be implemented with adjustable configurations (e.g., center frequency, cut off frequency, gain coefficient, delay amount, etc.). In one example, the nonspatial component processor 620 generates the crosstalk compensation signal Z, according to equation below:

$$Z = D[F[G_n * X_n]] \quad \text{Eq. (10)}$$

As described above with respect to FIG. 2A above, the configurations of compensating for the crosstalk cancellation can be determined by the speaker parameters 204, for example, according to the following Table 2 and Table 3 as a first look up table:

TABLE 2

Example configurations of crosstalk compensation for a small speaker (e.g., output frequency range between 250 Hz and 14000 Hz).

| Speaker Angle (°) | Filter Center Frequency (Hz) | Filter Gain (dB) | Quality Factor (Q) |
|---|---|---|---|
| 1 | 1500 | 14 | 0.35 |
| 10 | 1000 | 8 | 0.5 |
| 20 | 800 | 5.5 | 0.5 |
| 30 | 600 | 3.5 | 0.5 |
| 40 | 450 | 3.0 | 0.5 |
| 50 | 350 | 2.5 | 0.5 |
| 60 | 325 | 2.5 | 0.5 |
| 70 | 300 | 3.0 | 0.5 |
| 80 | 280 | 3.0 | 0.5 |
| 90 | 260 | 3.0 | 0.5 |
| 100 | 250 | 3.0 | 0.5 |
| 110 | 245 | 4.0 | 0.5 |
| 120 | 240 | 4.5 | 0.5 |
| 130 | 230 | 5.5 | 0.5 |

TABLE 3

Example configurations of crosstalk compensation for a large speaker (e.g., output frequency range between 100 Hz and 16000 Hz).

| Speaker Angle (°) | Filter Center Frequency (Hz) | Filter Gain (dB) | Quality Factor (Q) |
|---|---|---|---|
| 1 | 1050 | 18.0 | 0.25 |
| 10 | 700 | 12.0 | 0.4 |
| 20 | 550 | 10.0 | 0.45 |
| 30 | 450 | 8.5 | 0.45 |

TABLE 3-continued

Example configurations of crosstalk compensation for a large speaker (e.g., output frequency range between 100 Hz and 16000 Hz).

| Speaker Angle (°) | Filter Center Frequency (Hz) | Filter Gain (dB) | Quality Factor (Q) |
|---|---|---|---|
| 40 | 400 | 7.5 | 0.45 |
| 50 | 335 | 7.0 | 0.45 |
| 60 | 300 | 6.5 | 0.45 |
| 70 | 266 | 6.5 | 0.45 |
| 80 | 250 | 6.5 | 0.45 |
| 90 | 233 | 6.0 | 0.45 |
| 100 | 210 | 6.5 | 0.45 |
| 110 | 200 | 7.0 | 0.45 |
| 120 | 190 | 7.5 | 0.45 |
| 130 | 185 | 8.0 | 0.45 |

In one example, for a particular type of speakers (small/portable speakers or large speakers), filter center frequency, filter gain and quality factor of the filter 670 can be determined, according to an angle formed between two speakers 280 with respect to a listener. In some embodiments, values between the speaker angles are used to interpolate other values.

In some embodiments, the nonspatial component processor 620 may be integrated into subband spatial audio processor 230 (e.g., mid/side processor 430) and compensate for spectral artifacts of a subsequent crosstalk cancellation for one or more frequency subbands.

Figure 7:
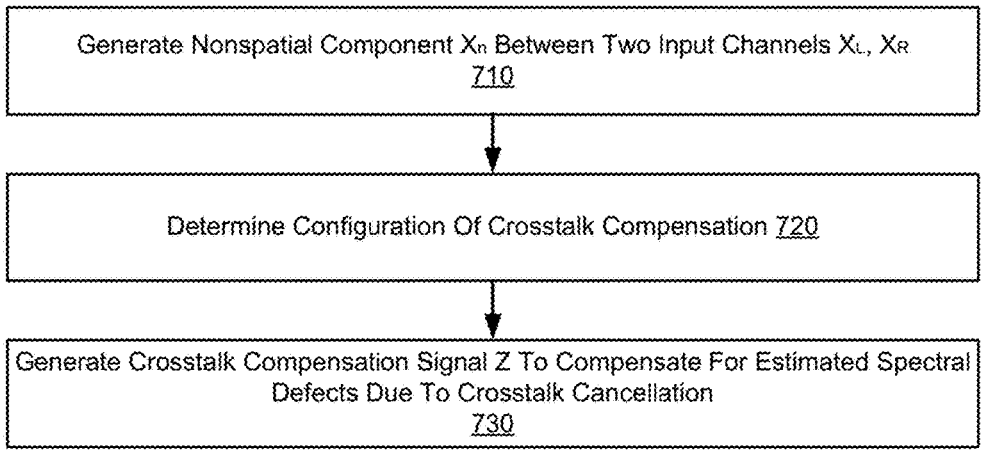
FIG. 7 illustrates an example method of performing compensation for crosstalk cancellation, according to one embodiment.

FIG. 7 illustrates an example method of performing compensation for crosstalk cancellation, as would be performed by the crosstalk compensation processor 240 according to one embodiment. In some embodiments, the crosstalk compensation processor 240 may perform the steps in parallel, perform the steps in different orders, or perform different steps.

The crosstalk compensation processor 240 receives an input audio signal comprising input channels $X_L$ and $X_R$. The crosstalk compensation processor 240 generates 710 a nonspatial component $X_n$ between the input channels $X_L$ and $X_R$, for example, according to Eq. (9) above.

The crosstalk compensation processor 240 determines 720 configurations (e.g., filter parameters) for performing crosstalk compensation as described above with respect to FIG. 6 above. The crosstalk compensation processor 240 generates 730 the crosstalk compensation signal Z to compensate for estimated spectral defects in the frequency response of a subsequent crosstalk cancellation applied to the input signals $X_L$ and $X_R$.

Figure 8:
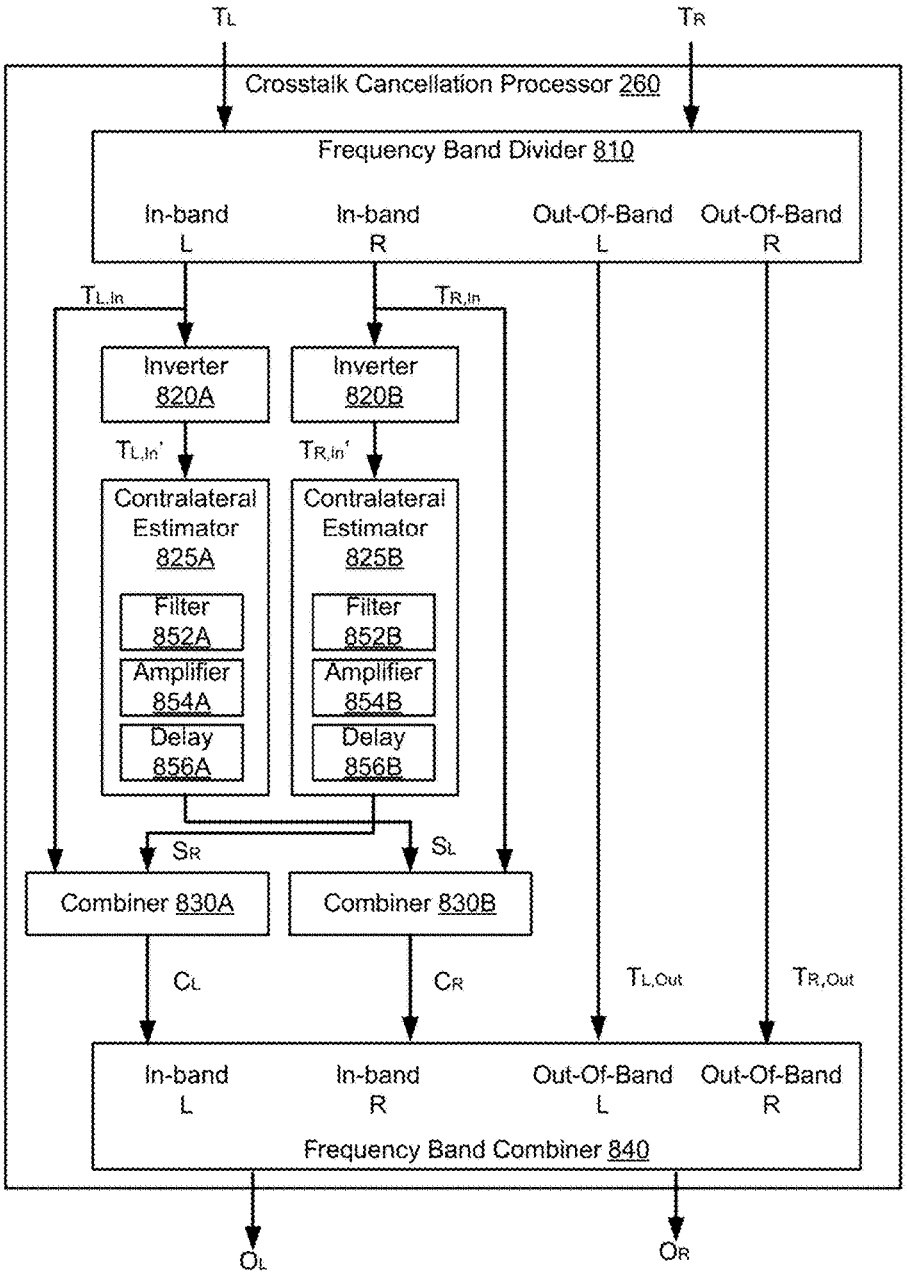
FIG. 8 illustrates an example diagram of a crosstalk cancellation processor, according to one embodiment.

FIG. 8 illustrates an example diagram of a crosstalk cancellation processor 260, according to one embodiment. The crosstalk cancellation processor 260 receives an input audio signal T comprising input channels $T_L$, $T_R$, and performs crosstalk cancellation on the channels $T_L$, $T_R$ to generate an output audio signal O comprising output channels $O_L$, $O_R$ (e.g., left and right channels). The input audio signal T may be output from the combiner 250 of FIG. 2B. Alternatively, the input audio signal T may be spatially enhanced audio signal Y from the subband spatial audio processor 230. In one embodiment, the crosstalk cancellation processor 260 includes a frequency band divider 810, inverters 820A, 820B, contralateral estimators 825A, 825B, and a frequency band combiner 840. In one approach, these components operate together to divide the input channels $T_L$, $T_R$ into inband components and out of band components, and perform a crosstalk cancellation on the inband components to generate the output channels $O_L$, $O_R$.

By dividing the input audio signal T into different frequency band components and by performing crosstalk cancellation on selective components (e.g., inband components), crosstalk cancellation can be performed for a particular frequency band while obviating degradations in other frequency bands. If crosstalk cancellation is performed without dividing the input audio signal T into different frequency bands, the audio signal after such crosstalk cancellation may exhibit significant attenuation or amplification in the nonspatial and spatial components in low frequency (e.g., below 350 Hz), higher frequency (e.g., above 12000 Hz), or both. By selectively performing crosstalk cancellation for the inband (e.g., between 250 Hz and 14000 Hz), where the vast majority of impactful spatial cues reside, a balanced overall energy, particularly in the nonspatial component, across the spectrum in the mix can be retained.

In one configuration, the frequency band divider 810 or a filterbank divides the input channels $T_L$, $T_R$ into inband channels $T_{L,In}$, $T_{R,In}$ and out of band channels $T_{L,Out}$, $T_{R,Out}$, respectively. Particularly, the frequency band divider 810 divides the left input channel $T_L$ into a left inband channel $T_{L,In}$ and a left out of band channel $T_{L,Out}$. Similarly, the frequency band divider 810 divides the right input channel $T_R$ into a right inband channel $T_{R,In}$ and a right out of band channel $T_{R,Out}$. Each inband channel may encompass a portion of a respective input channel corresponding to a frequency range including, for example, 250 Hz to 14 kHz. The range of frequency bands may be adjustable, for example according to speaker parameters 204.

The inverter 820A and the contralateral estimator 825A operate together to generate a contralateral cancellation component $S_L$ to compensate for a contralateral sound component due to the left inband channel $T_{L,In}$. Similarly, the inverter 820B and the contralateral estimator 825B operate together to generate a contralateral cancellation component $S_R$ to compensate for a contralateral sound component due to the right inband channel $T_{R,In}$.

In one approach, the inverter 820A receives the inband channel $T_{L,In}$ and inverts a polarity of the received inband channel $T_{L,In}$ to generate an inverted inband channel $T_{L,In}'$. The contralateral estimator 825A receives the inverted inband channel $T_{L,In}'$, and extracts a portion of the inverted inband channel $T_{L,In}'$ corresponding to a contralateral sound component through filtering. Because the filtering is performed on the inverted inband channel $T_{L,In}'$, the portion extracted by the contralateral estimator 825A becomes an inverse of a portion of the inband channel $T_{L,In}$ attributing to the contralateral sound component. Hence, the portion extracted by the contralateral estimator 825A becomes a contralateral cancellation component $S_L$, which can be added to a counterpart inband channel $T_{R,In}$ to reduce the contralateral sound component due to the inband channel $T_{L,In}$. In some embodiments, the inverter 820A and the contralateral estimator 825A are implemented in a different sequence.

The inverter 820B and the contralateral estimator 825B perform similar operations with respect to the inband channel $T_{R,In}$ to generate the contralateral cancellation component $S_R$. Therefore, detailed description thereof is omitted herein for the sake of brevity.

In one example implementation, the contralateral estimator 825A includes a filter 852A, an amplifier 854A, and a delay unit 856A. The filter 852A receives the inverted input channel and extracts a portion of the inverted inband channel $T_{L,In}'$ corresponding to a contralateral sound component through filtering function F. An example filter implementation is a Notch or Highshelf filter with a center frequency selected between 5000 and 10000 Hz, and Q selected between 0.5 and 1.0. Gain in decibels ($G_{dB}$) may be derived from the following formula:

$$G_{dB}=-3.0-\log_{1.333}(D) \quad \text{Eq. (11)}$$

where D is a delay amount by delay unit 856A/B in samples, for example, at a sampling rate of 48 KHz. An alternate implementation is a Lowpass filter with a corner frequency selected between 5000 and 10000 Hz, and Q selected between 0.5 and 1.0. Moreover, the amplifier 854A amplifies the extracted portion by a corresponding gain coefficient $G_{L,In}$, and the delay unit 856A delays the amplified output from the amplifier 854A according to a delay function D to generate the contralateral cancellation component $S_L$. The contralateral estimator 825B performs similar operations on the inverted inband channel $T_{R,In}'$ to generate the contralateral cancellation component $S_R$. In one example, the contralateral estimators 825A, 825B generate the contralateral cancellation components $S_L$, $S_R$, according to equations below:

$$S_L=D[G_{L,In}*F[T_{L,In}']] \quad \text{Eq. (12)}$$

$$S_R=D[G_{R,In}*F[T_{R,In}']] \quad \text{Eq. (13)}$$

As described above with respect to FIG. 2A above, the configurations of the crosstalk cancellation can be determined by the speaker parameters 204, for example, according to the following Table 4 as a second look up table:

TABLE 4

Example configurations of crosstalk cancellation

| Speaker Angle (°) | Delay (ms) | Amplifier Gain (dB) | Filter Gain |
|---|---|---|---|
| 1 | 0.00208333 | −0.25 | −3.0 |
| 10 | 0.0208333 | −0.25 | −3.0 |
| 20 | 0.041666 | −0.5 | −6.0 |
| 30 | 0.0625 | −0.5 | −6.875 |
| 40 | 0.08333 | −0.5 | −7.75 |
| 50 | 0.1041666 | −0.5 | −8.625 |
| 60 | 0.125 | −0.5 | −9.165 |
| 70 | 0.1458333 | −0.5 | −9.705 |
| 80 | 0.1666 | −0.5 | −10.25 |
| 90 | 0.1875 | −0.5 | −10.5 |
| 100 | 0.208333 | −0.5 | −10.75 |
| 110 | 0.2291666 | −0.5 | −11.0 |
| 120 | 0.25 | −0.5 | −11.25 |
| 130 | 0.27083333 | −0.5 | −11.5 |

In one example, filter center frequency, delay amount, amplifier gain, and filter gain can be determined, according to an angle formed between two speakers 280 with respect to a listener. In some embodiments, values between the speaker angles are used to interpolate other values.

The combiner 830A combines the contralateral cancellation component $S_R$ to the left inband channel $T_{L,In}$ to generate a left inband compensated channel $C_L$, and the combiner 830B combines the contralateral cancellation component $S_L$ to the right inband channel $T_{R,In}$ to generate a right inband compensated channel $C_R$. The frequency band combiner 840 combines the inband compensated channels $C_L$, $C_R$ with the out of band channels $T_{L,Out}$, $T_{R,Out}$ to generate the output audio channels $O_L$, $O_R$, respectively.

Accordingly, the output audio channel $O_L$ includes the contralateral cancellation component $S_R$ corresponding to an inverse of a portion of the inband channel $T_{R,In}$ attributing to the contralateral sound, and the output audio channel $O_R$ includes the contralateral cancellation component $S_L$ corresponding to an inverse of a portion of the inband channel $T_{L,In}$ attributing to the contralateral sound. In this configuration, a wavefront of an ipsilateral sound component output by the speaker $\mathbf{280}_R$ according to the output channel $O_R$ arrived at the right ear can cancel a wavefront of a contralateral sound component output by the speaker $\mathbf{280}_L$ according to the output channel $O_L$. Similarly, a wavefront of an ipsilateral sound component output by the speaker $\mathbf{280}_L$ according to the output channel $O_L$ arrived at the left ear can cancel a wavefront of a contralateral sound component output by the speaker $\mathbf{280}_R$ according to the output channel $O_R$. Thus, contralateral sound components can be reduced to enhance spatial detectability.

Figure 9:
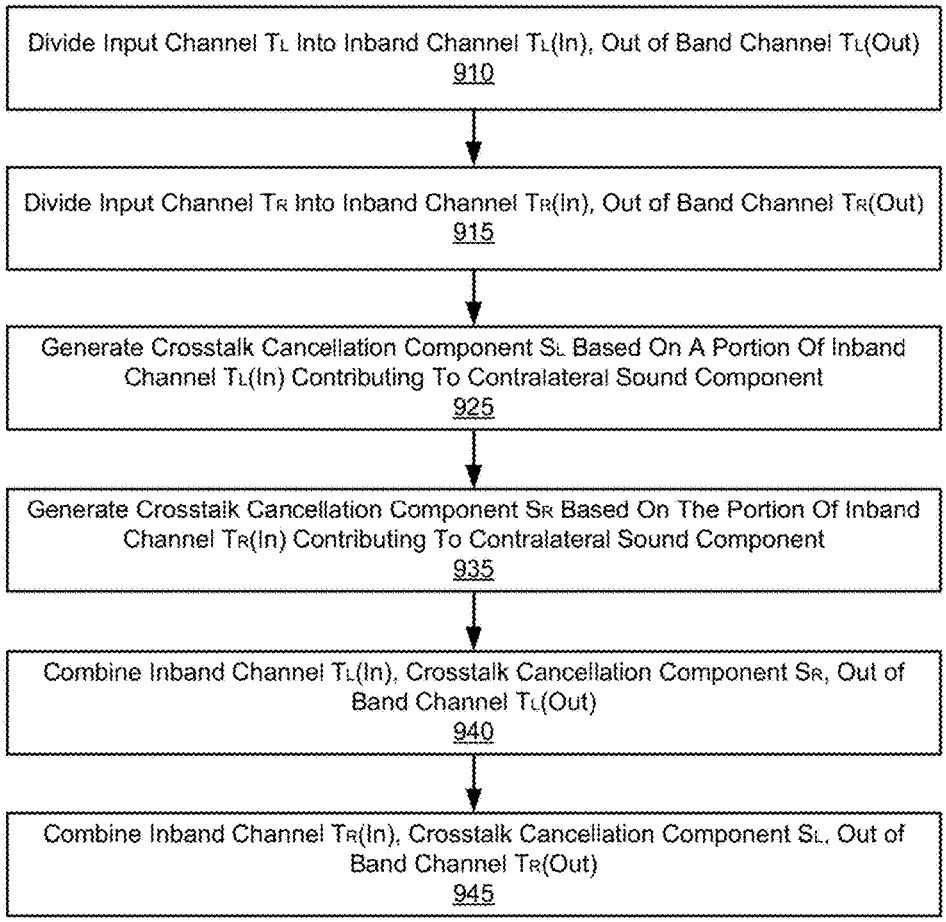
FIG. 9 illustrates an example method of performing crosstalk cancellation, according to one embodiment.

FIG. 9 illustrates an example method of performing crosstalk cancellation, as would be performed by the crosstalk cancellation processor 260 according to one embodiment. In some embodiments, the crosstalk cancellation processor 260 may perform the steps in parallel, perform the steps in different orders, or perform different steps.

The crosstalk cancellation processor 260 receives an input signal comprising input channels $T_L$, $T_R$. The input signal may be output $T_L$, $T_R$ from the combiner 250. The crosstalk cancellation processor 260 divides 910 an input channel $T_L$ into an inband channel $T_{L,In}$ and an out of band channel $T_{L,Out}$. Similarly, the crosstalk cancellation processor 260 divides 915 the input channel $T_R$ into an inband channel $T_{R,In}$ and an out of band channel $T_{R,Out}$. The input channels $T_L$, $T_R$ may be divided into the in-band channels and the out of band channels by the frequency band divider 810, as described above with respect to FIG. 8 above.

The crosstalk cancellation processor 260 generates 925 a crosstalk cancellation component $S_L$ based on a portion of the inband channel $T_{L,In}$ contributing to a contralateral sound component for example, according to Table 4 and Eq. (12) above. Similarly, the crosstalk cancellation processor 260 generates 935 a crosstalk cancellation component $S_R$ contributing to a contralateral sound component based on the identified portion of the inband channel $T_{R,In}$, for example, according to Table 4 and Eq. (13).

The crosstalk cancellation processor 260 generates an output audio channel $O_L$ by combining 940 the inband channel $T_{L,In}$, crosstalk cancellation component $S_R$, and out of band channel $T_{L,Out}$. Similarly, the crosstalk cancellation processor 260 generates an output audio channel $O_R$ by combining 945 the inband channel $T_{R,In}$ crosstalk cancellation component $S_L$, and out of band channel $T_{R,Out}$.

The output channels $O_L$, $O_R$ can be provided to respective speakers to reproduce stereo sound with reduced crosstalk and improved spatial detectability.

Figure 10:
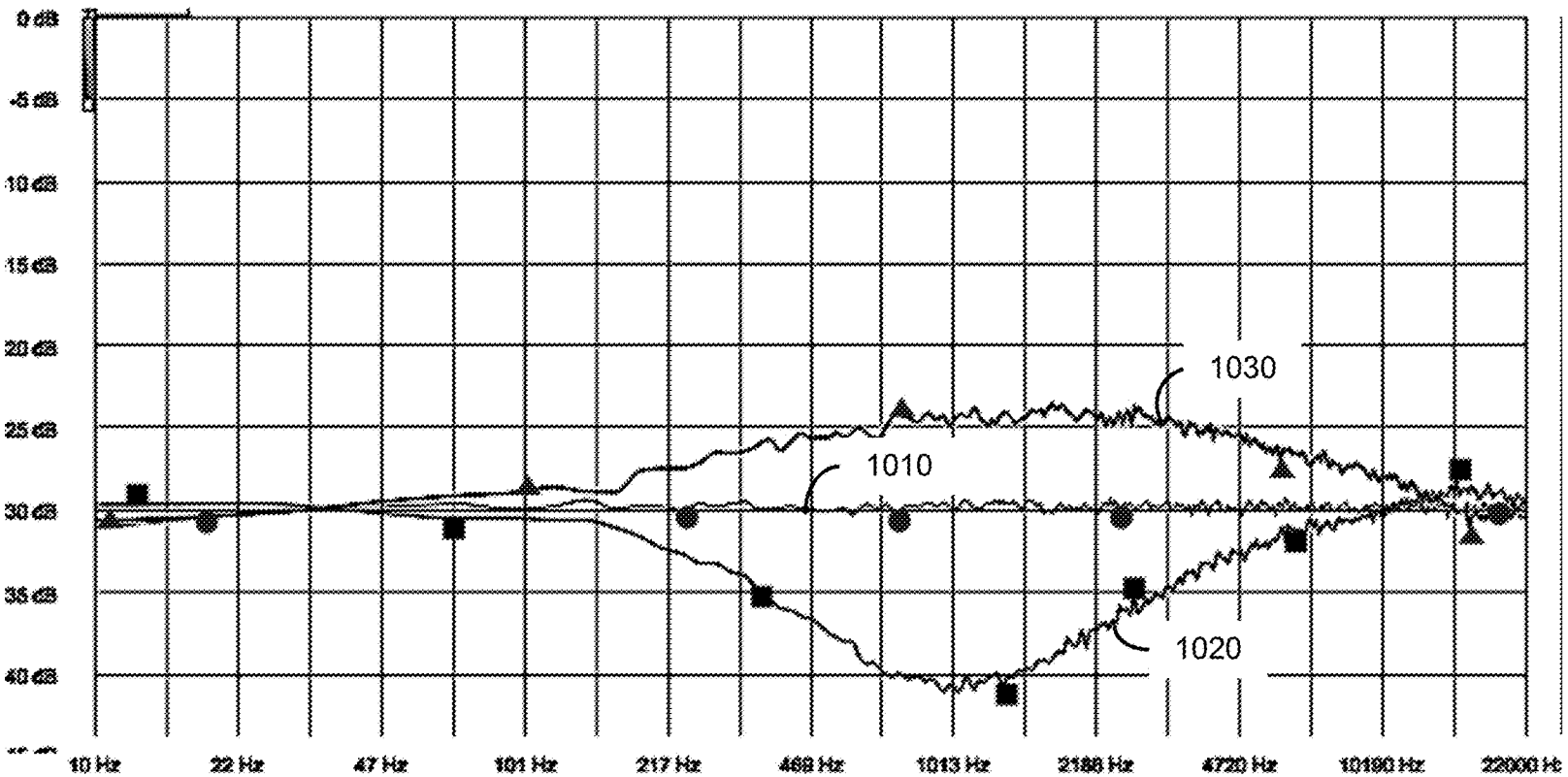
FIGS. 10 and 11 illustrate example frequency response plots for demonstrating spectral artifacts due to crosstalk cancellation.
Figure 11:
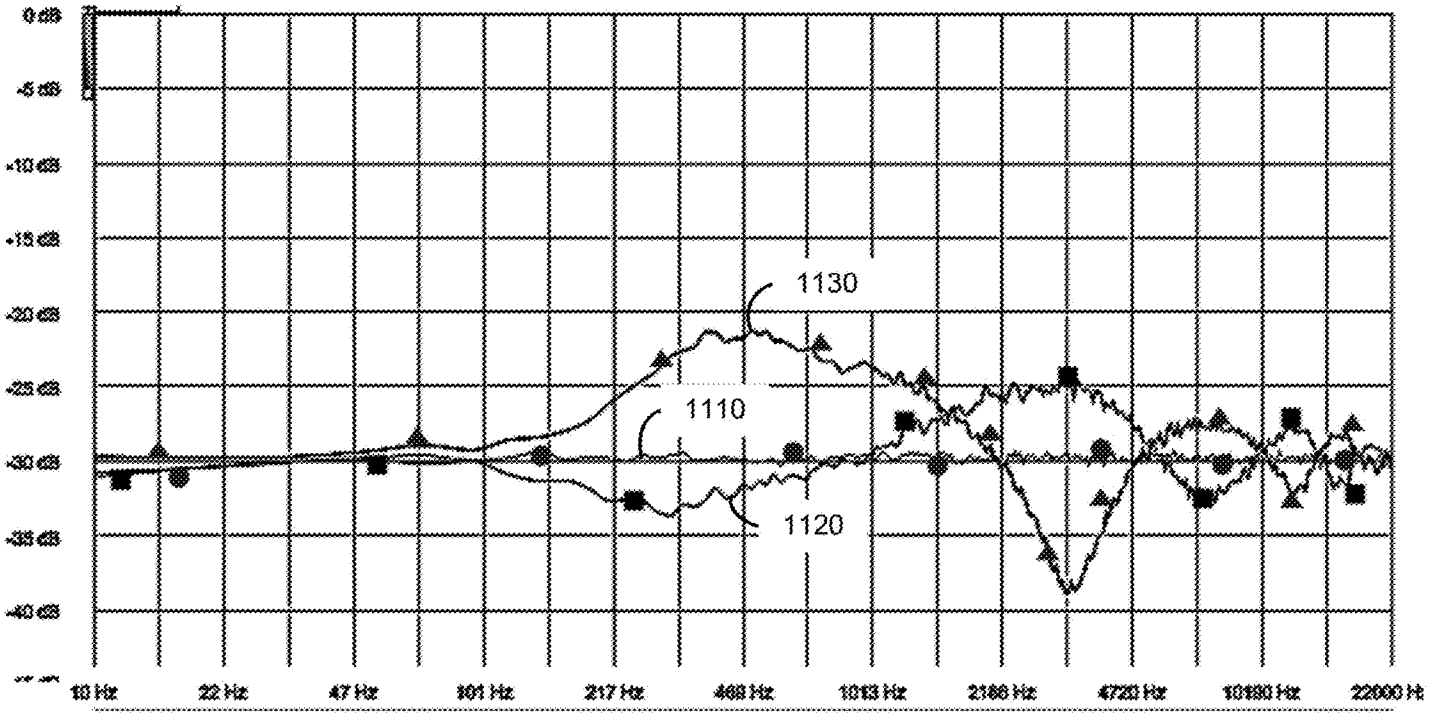

FIGS. 10 and 11 illustrate example frequency response plots for demonstrating spectral artifacts due to crosstalk cancellation. In one aspect, the frequency response of the crosstalk cancellation exhibits comb filter artifacts. These comb filter artifacts exhibit inverted responses in the spatial and nonspatial components of the signal. FIG. 10 illustrates the artifacts resulting from crosstalk cancellation employing 1 sample delay at a sampling rate of 48 KHz, and FIG. 11 illustrates the artifacts resulting from crosstalk cancellation employing 6 sample delays at a sampling rate of 48 KHz. Plot 1010 is a frequency response of a white noise input signal; plot 1020 is a frequency response of a non-spatial (correlated) component of the crosstalk cancellation employing 1 sample delay; and plot 1030 is a frequency response of a spatial (noncorrelated) component of the crosstalk cancellation employing 1 sample delay. Plot 1110 is a frequency response of a white noise input signal; plot 1120 is a frequency response of a non-spatial (correlated) component of the crosstalk cancellation employing 6 sample delay; and plot 1130 is a frequency response of a spatial (noncorrelated) component of the crosstalk cancellation employing 6 sample delay. By changing the delay of the crosstalk compensation, the number and center frequency of the peaks and troughs occurring below the Nyquist frequency can be changed.

Figure 12:
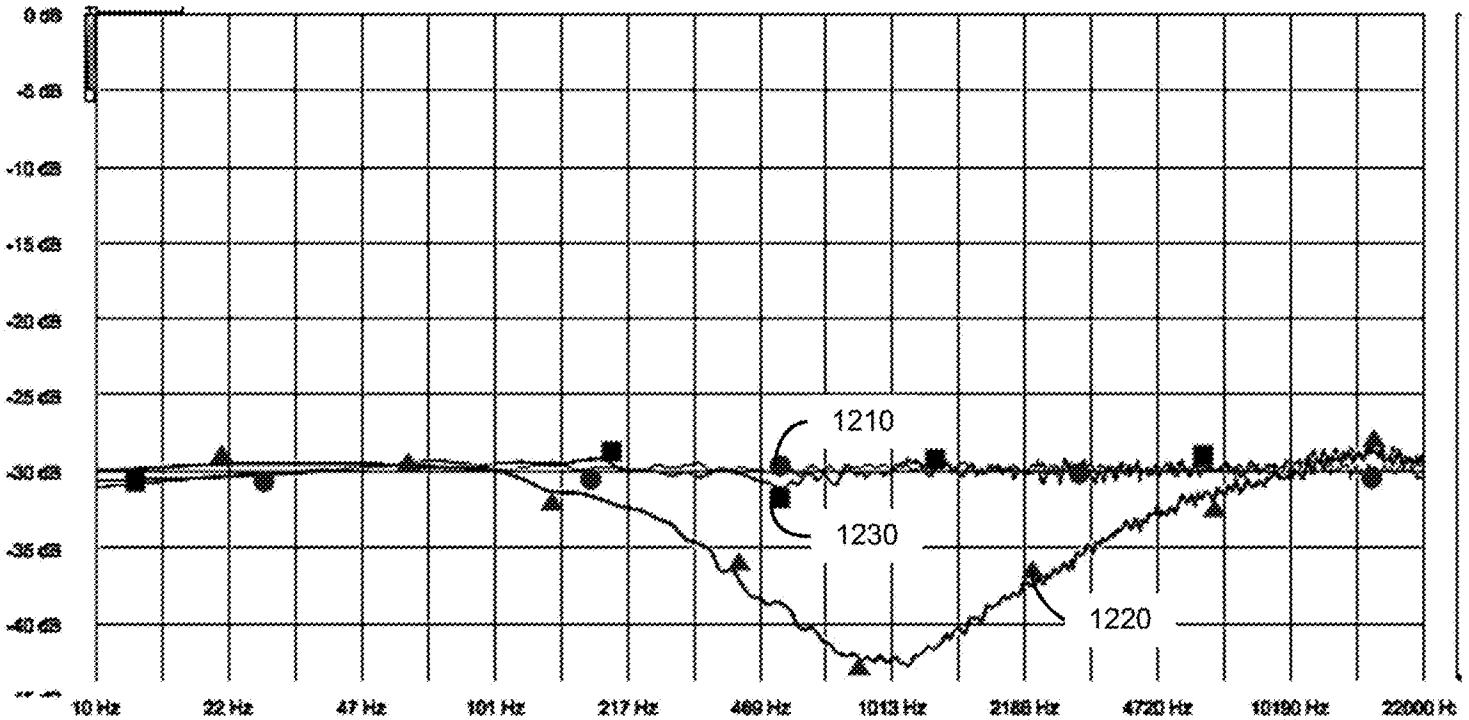
FIGS. 12 and 13 illustrate example frequency response plots for demonstrating effects of crosstalk compensation.
Figure 13:
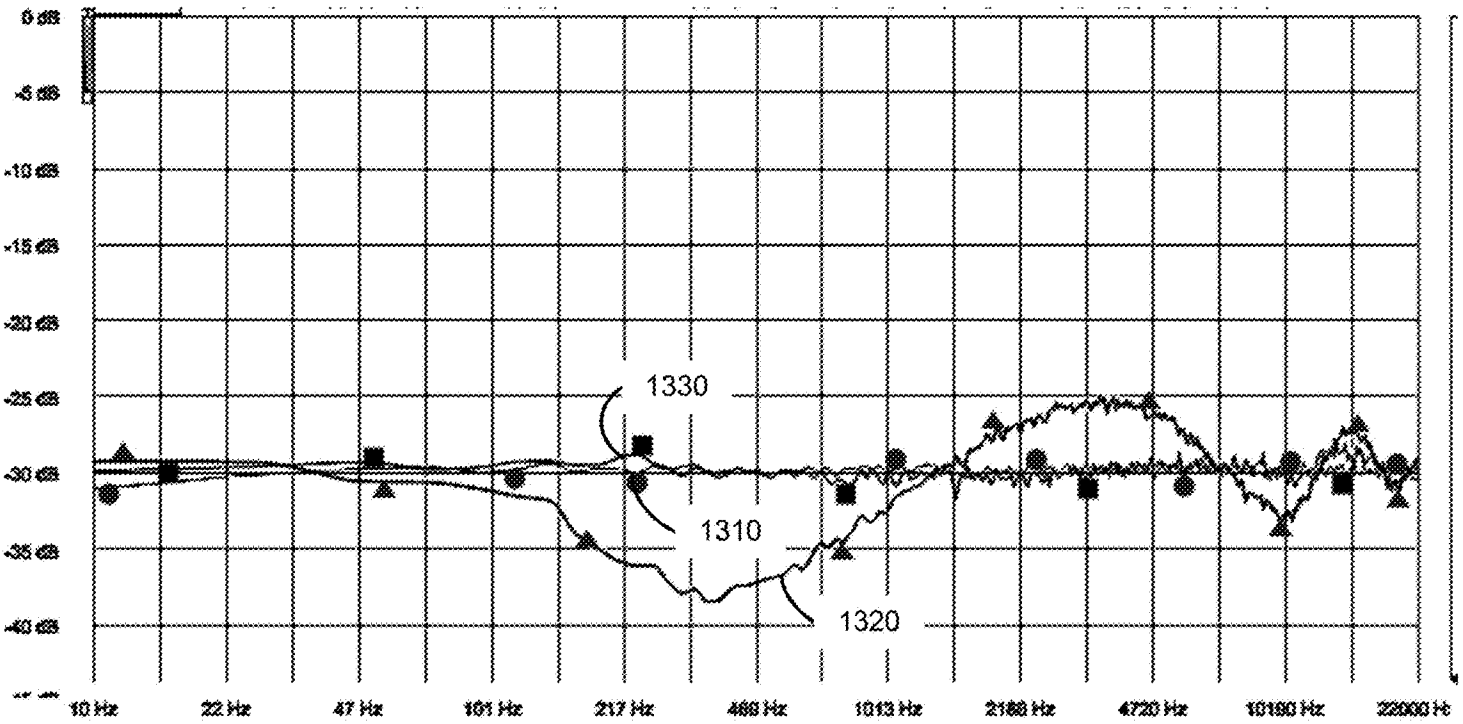

FIGS. 12 and 13 illustrate example frequency response plots for demonstrating effects of crosstalk compensation. Plot 1210 is a frequency response of a white noise input signal; plot 1220 is a frequency response of a non-spatial (correlated) component of a crosstalk cancellation employing 1 sample delay without the crosstalk compensation; and plot 1230 is a frequency response of a non-spatial (correlated) component of the crosstalk cancellation employing 1 sample delay with the crosstalk compensation. Plot 1310 is a frequency response of a white noise input signal; plot 1320 is a frequency response of a non-spatial (correlated) component of a crosstalk cancellation employing 6 sample delay without the crosstalk compensation; and plot 1330 is a frequency response of a non-spatial (correlated) component of the crosstalk cancellation employing 6 sample delay with the crosstalk compensation. In one example, the crosstalk compensation processor 240 applies a peaking filter to the non-spatial component for a frequency range with a trough and applies a notch filter to the non-spatial component for a frequency range with a peak for another frequency range to flatten the frequency response as shown in plots 1230 and 1330. As a result, a more stable perceptual presence of center-panned musical elements can be produced. Other parameters such as a center frequency, gain, and Q of the crosstalk cancellation may be determined by a second look up table (e.g., Table 4 above) according to speaker parameters 204.

Figure 14:
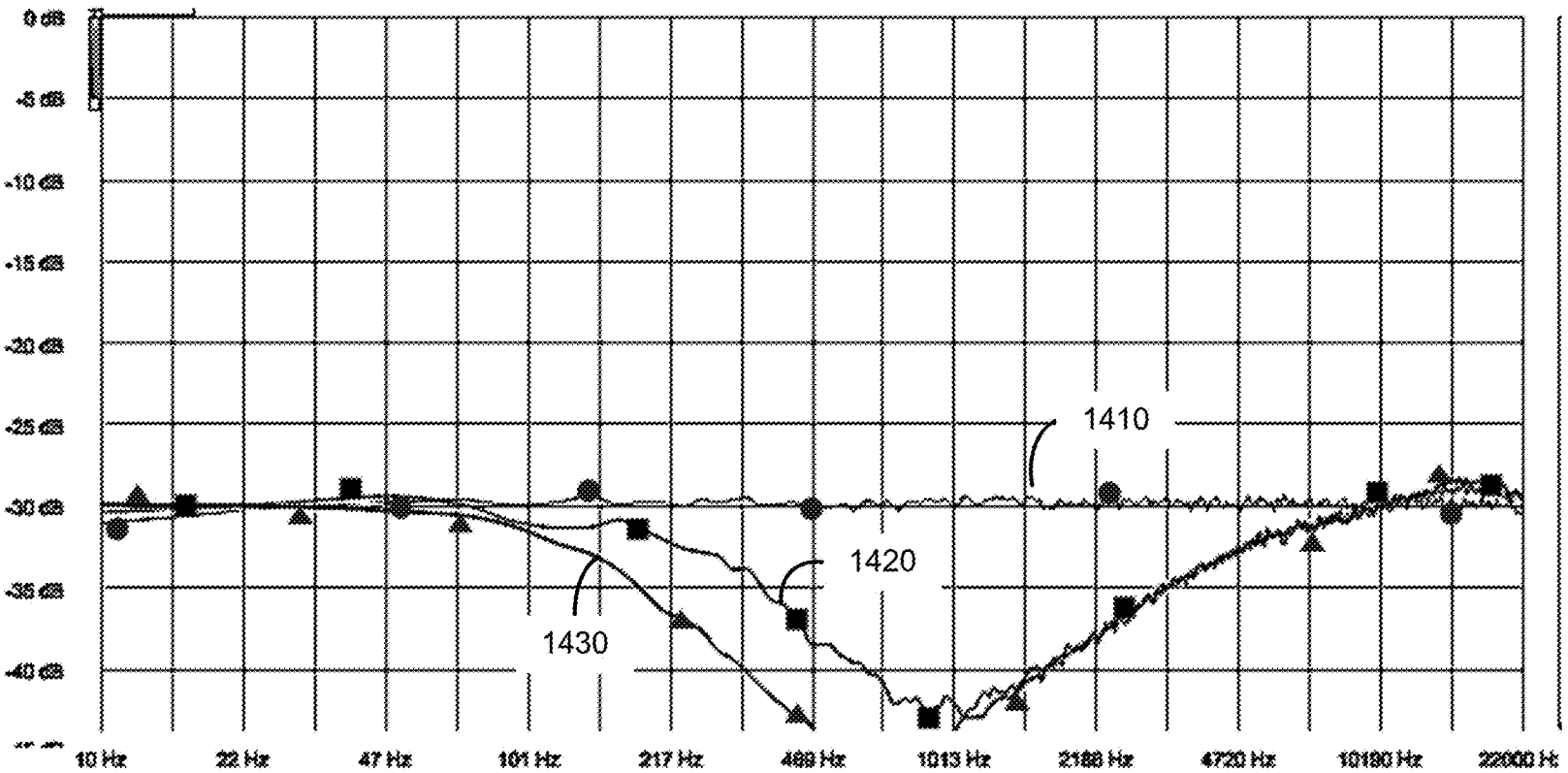
FIG. 14 illustrates example frequency responses for demonstrating effects of changing corner frequencies of the frequency band divider shown in FIG. 8.

FIG. 14 illustrates example frequency responses for demonstrating effects of changing corner frequencies of the frequency band divider shown in FIG. 8. Plot 1410 is a frequency response of a white noise input signal; plot 1420 is a frequency response of a non-spatial (correlated) component of a crosstalk cancellation employing In-Band corner frequencies of 350-12000 Hz; and plot 1430 is a frequency response of a non-spatial (correlated) component of the crosstalk cancellation employing In-Band corner frequencies of 200-14000 Hz. As shown in FIG. 14, changing the cut off frequencies of the frequency band divider 810 of FIG. 8 affects the frequency response of the crosstalk cancellation.

Figure 15:
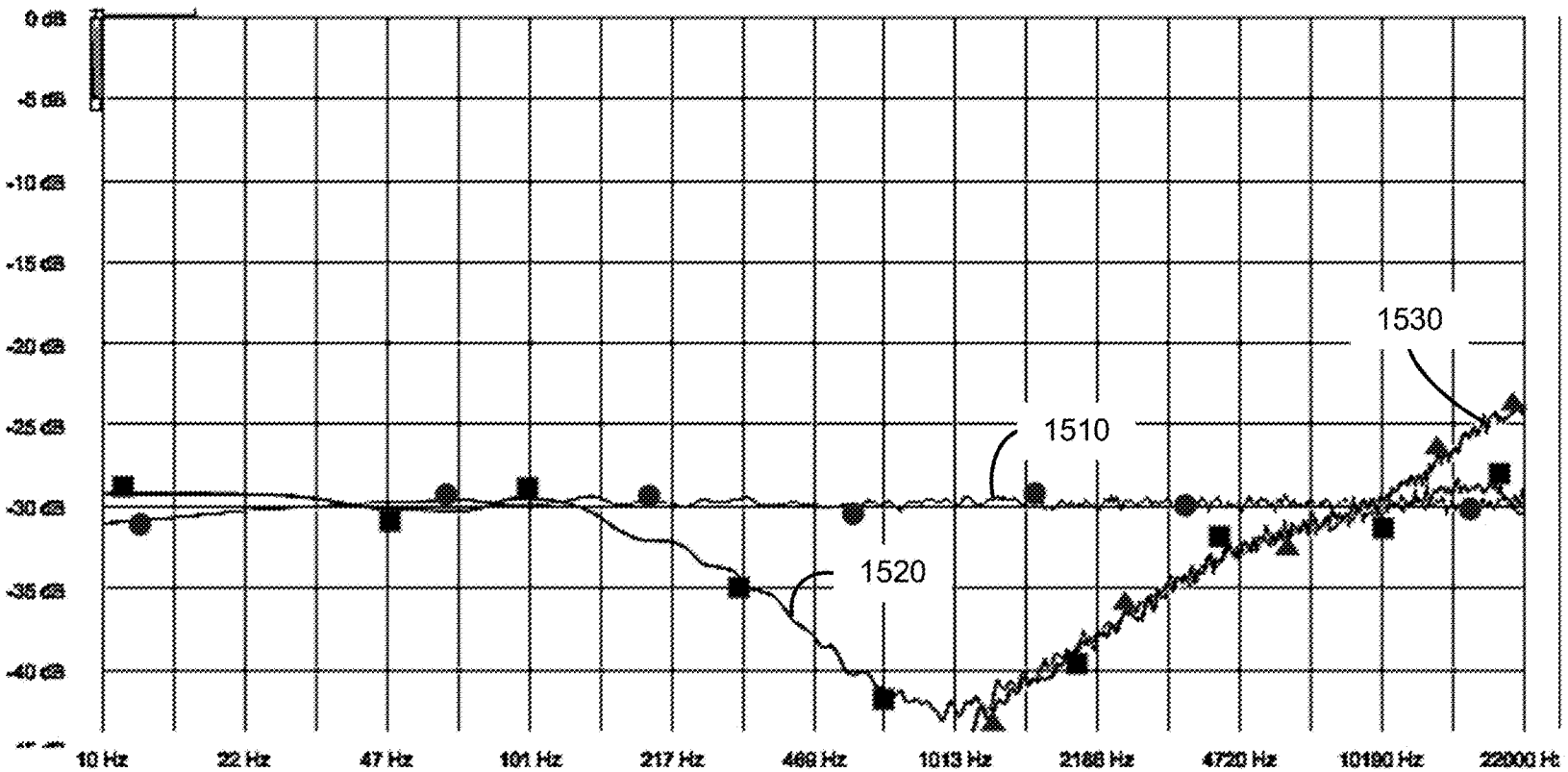
FIGS. 15 and 16 illustrate examples frequency responses for demonstrating effects of the frequency band divider shown in FIG. 8.
Figure 16:
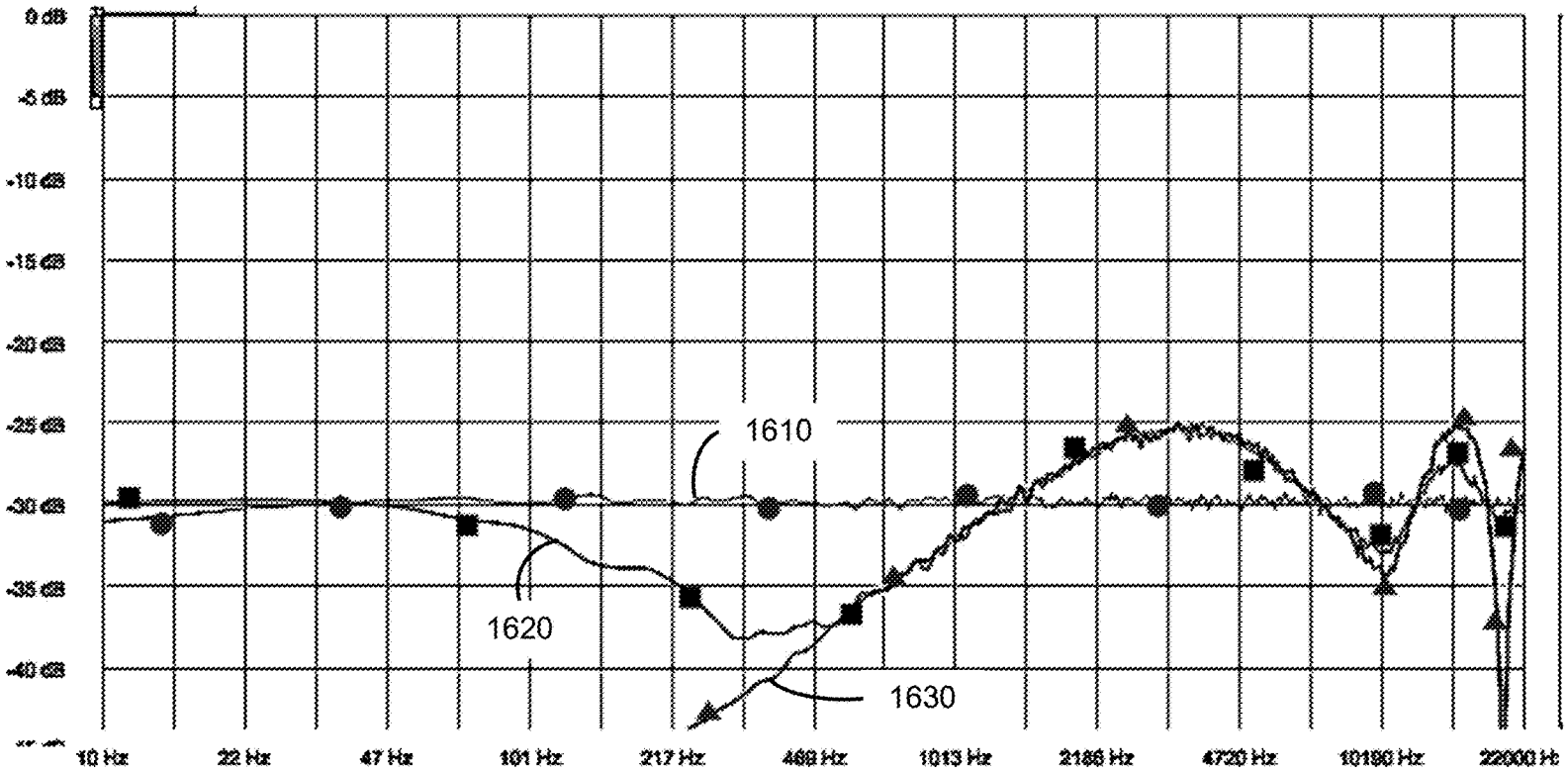

FIGS. 15 and 16 illustrate examples frequency responses for demonstrating effects of the frequency band divider 810 shown in FIG. 8. Plot 1510 is a frequency response of a white noise input signal; plot 1520 is a frequency response of a non-spatial (correlated) component of a crosstalk cancellation employing 1 sample delay at a 48 KHz sampling rate and inband frequency range of 350 to 12000 Hz; and plot 1530 is a frequency response of a non-spatial (correlated) component of a crosstalk cancellation employing 1 sample delay at a 48 KHz sampling rate for the entire frequency without the frequency band divider 810. Plot 1610 is a frequency response of a white noise input signal; plot 1620 is a frequency response of a non-spatial (correlated) component of a crosstalk cancellation employing 6 sample delay at a 48 KHz sampling rate and inband frequency range of 250 to 14000 Hz; and plot 1630 is a frequency response of a non-spatial (correlated) component of a crosstalk cancellation employing 6 sample delay at a 48 KHz sampling rate for the entire frequency without the frequency band divider 810. By applying crosstalk cancellation without the frequency band divider 810, the plot 1530 shows significant suppression below 1000 Hz and a ripple above 10000 Hz. Similarly, the plot 1630 shows significant suppression below 400 Hz and a ripple above 1000 Hz. By implementing the frequency band divider 810 and selectively performing crosstalk cancellation on the selected frequency band, suppression at low frequency regions (e.g., below 1000 Hz) and ripples at high frequency region (e.g., above 10000 Hz) can be reduced as shown in plots 1520 and 1620.

Upon reading this disclosure, those of skill in the art will appreciate still additional alternative embodiments through the disclosed principles herein. Thus, while particular embodiments and applications have been illustrated and described, it is to be understood that the disclosed embodiments are not limited to the precise construction and components disclosed herein. Various modifications, changes and variations, which will be apparent to those skilled in the art, may be made in the arrangement, operation and details of the method and apparatus disclosed herein without departing from the scope described herein.

Any of the steps, operations, or processes described herein may be performed or implemented with one or more hardware or software modules, alone or in combination with other devices. In one embodiment, a software module is implemented with a computer program product comprising a computer readable medium (e.g., non-transitory computer readable medium) containing computer program code, which can be executed by a computer processor for performing any or all of the steps, operations, or processes described.

What is claimed is:

1. A method of producing a first sound and a second sound, the method comprising:

receiving an input audio signal comprising a first input channel and a second input channel;

dividing the first input channel into first subband components, each of the first subband components corresponding to one frequency band from a group of frequency bands, at least one frequency band of the group of frequency bands including a set of critical bands;

dividing the second input channel into second subband components, each of the second subband components corresponding to one frequency band from the group of frequency bands;

generating, for each of the frequency bands, a correlated portion between a corresponding first subband component and a corresponding second subband component;

generating, for each of the frequency bands, a non-correlated portion between the corresponding first subband component and the corresponding second subband component;

amplifying, for each of the frequency bands, the correlated portion with respect to the non-correlated portion to obtain an enhanced spatial component and an enhanced non-spatial component;

generating, for each of the frequency bands, an enhanced first subband component by obtaining a sum of the enhanced spatial component and the enhanced non-spatial component;

generating, for each of the frequency bands, an enhanced second subband component by obtaining a difference between the enhanced spatial component and the enhanced non-spatial component;

generating a first spatially enhanced channel by combining enhanced first subband components of the frequency bands; and generating a second spatially enhanced channel by combining enhanced second subband components of the frequency bands.

2. The method of claim 1, wherein a correlated portion between a first subband component and a second subband component of a frequency band includes non-spatial information of the frequency band, and wherein a non-correlated portion between the first subband component and the second subband component of the frequency band includes spatial information of the frequency band.

3. The method of claim 1, further comprising:

generating a correlated portion between the first input channel and the second input channel;

generating a crosstalk compensation signal based on the correlated portion between the first input channel and the second input channel;

adding the crosstalk compensation signal to the first spatially enhanced channel to generate a first precompensated channel; and adding the crosstalk compensation signal to the second spatially enhanced channel to generate a second precompensated channel.

4. The method of claim 3, wherein generating the crosstalk compensation signal comprises:

generating the crosstalk compensation signal to remove estimated spectral defects in a frequency response of a subsequent crosstalk cancellation.

5. The method of claim 3, further comprising:

dividing the first precompensated channel into a first inband channel corresponding to an inband frequency and a first out of band channel corresponding to an out of band frequency;

dividing the second precompensated channel into a second inband channel corresponding to the inband frequency and a second out of band channel corresponding to the out of band frequency;

generating a first crosstalk cancellation component to compensate for a first contralateral sound component contributed by the first inband channel;

generating a second crosstalk cancellation component to compensate for a second contralateral sound component contributed by the second inband channel;

combining the first inband channel, the second crosstalk cancellation component, and the first out of band channel to generate a first compensated channel; and combining the second inband channel, the first crosstalk cancellation component, and the second out of band channel to generate a second compensated channel.

6. The method of claim 5, wherein generating the first crosstalk cancellation component comprises:

estimating the first contralateral sound component contributed by the first inband channel; and generating the first crosstalk cancellation component from an inverse of the estimated first contralateral sound component, and wherein generating the second crosstalk cancellation component comprises:

estimating the second contralateral sound component contributed by the second inband channel; and generating the second crosstalk cancellation component from an inverse of the estimated second contralateral sound component.

7. The method of claim 1, wherein the set of critical bands includes critical bands of a Bark scale.

8. The method of claim 1, further comprising determining the set of critical bands of the at least one frequency band by:

determining a long term average energy ratio between correlated components and non-correlated components of audio samples over the critical bands; and grouping contiguous frequency bands according to the long term average energy ratios of the critical bands.

9. The method of claim 1, wherein amplifying, for each of the frequency bands, the correlated portion with respect to the non-correlated portion includes applying, for the at least one frequency band, a first gain coefficient to the correlated portion of the at least one frequency band and a second gain coefficient different from the first gain coefficient to the non-correlated portion of the at least one frequency band.

10. The method of claim 1, further including, for the at least one frequency band, applying a first time delay to the correlated portion of the at least one frequency band and applying a second time delay different from the first time delay to the non-correlated portion of the at least one frequency band.

11. A system comprising:

a subband spatial audio processor, the subband spatial audio processor including:

a frequency band divider configured to:

receive an input audio signal comprising a first input channel and a second input channel, divide the first input channel into first subband components, each of the first subband components corresponding to one frequency band from a group of frequency bands, at least one frequency band of the group of frequency bands including a set of critical bands, and divide the second input channel into second subband components, each of the second subband components corresponding to one frequency band from the group of frequency bands, converters coupled to the frequency band divider, each converter configured to:

generate, for a corresponding frequency band from the group of frequency bands, a correlated portion between a corresponding first subband component and a corresponding second subband component, and generate, for the corresponding frequency band, a non-correlated portion between the corresponding first subband component and the corresponding second subband component, subband processors, each subband processor coupled to a converter for a corresponding frequency band, each subband processor configured to amplify, for the corresponding frequency band, the correlated portion with respect to the non-correlated portion to obtain an enhanced spatial component and an enhanced non-spatial component, reverse converters, each reverse converter coupled to a corresponding subband processor, each reverse converter configured to:

generate, for a corresponding frequency band, an enhanced first subband component by obtaining a sum of the enhanced spatial component and the enhanced non-spatial component, and generate, for the corresponding frequency band, an enhanced second subband component by obtaining a difference between the enhanced spatial component and the enhanced non-spatial component, and a frequency band combiner coupled to the reverse converters, the frequency band combiner configured to:

generate a first spatially enhanced channel by combining enhanced first subband components of the frequency bands, and generate a second spatially enhanced channel by combining enhanced second subband components of the frequency bands.

12. The system of claim 11, wherein a correlated portion between a first subband component and a second subband component of a frequency band includes non-spatial information of the frequency band, and wherein a non-correlated portion between the first subband component and the second subband component of the frequency band includes spatial information of the frequency band.

13. The system of claim 11, further comprising a non-spatial audio processor configured to:

generate a correlated portion between the first input channel and the second input channel, and generate a crosstalk compensation signal based on the correlated portion between the first input channel and the second input channel.

14. The system of claim 13, wherein the non-spatial audio processor generates the crosstalk compensation signal by:

generating the crosstalk compensation signal to remove estimated spectral defects in a frequency response of a subsequent crosstalk cancellation.

15. The system of claim 14, further comprising a combiner coupled to the subband spatial audio processor and the non-spatial audio processor, the combiner configured to:

add the crosstalk compensation signal to the first spatially enhanced channel to generate a first precompensated channel, and add the crosstalk compensation signal to the second spatially enhanced channel to generate a second precompensated channel.

16. The system of claim 15, further comprising: a crosstalk cancellation processor coupled to the combiner, the crosstalk cancellation processor configured to:

divide the first precompensated channel into a first inband channel corresponding to an inband frequency and a first out of band channel corresponding to an out of band frequency;

divide the second precompensated channel into a second inband channel corresponding to the inband frequency and a second out of band channel corresponding to the out of band frequency;

generate a first crosstalk cancellation component to compensate for a first contralateral sound component contributed by the first inband channel;

generate a second crosstalk cancellation component to compensate for a second contralateral sound component contributed by the second inband channel;

combine the first inband channel, the second crosstalk cancellation component and the first out of band channel to generate a first compensated channel; and combine the second inband channel, the first crosstalk cancellation component, and the second out of band channel to generate a second compensated channel.

17. The system of claim 16, further comprising:

a first speaker coupled to the crosstalk cancellation processor, the first speaker configured to produce a first sound according to the first compensated channel; and a second speaker coupled to the crosstalk cancellation processor, the second speaker configured to produce a second sound according to the second compensated channel.

18. The system of claim 16, wherein the crosstalk cancellation processor includes:

a first inverter configured to generate an inverse of the first inband channel, a first contralateral estimator coupled to the first inverter, the first contralateral estimator configured to estimate the first contralateral sound component contributed by the first inband channel and to generate the first crosstalk cancellation component corresponding to an inverse of the first contralateral sound component according to the inverse of the first inband channel, a second inverter configured to generate an inverse of the second inband channel, and a second contralateral estimator coupled to the second inverter, the second contralateral estimator configured to estimate the second contralateral sound component contributed by the second inband channel and to generate the second crosstalk cancellation component corresponding to an inverse of the second contralateral sound component according to the inverse of the second inband channel.

19. The system of claim 11, wherein the set of critical bands includes critical bands of a Bark scale.

20. The system of claim 11, wherein the frequency band divider is configured to determine the set of critical bands of the at least one frequency band by:

determining a long term average energy ratio between correlated components and non-correlated components of audio samples over the critical bands; and grouping contiguous critical bands according to the long term average energy ratios of the critical bands.

21. The system of claim 11, wherein each subband processor configured to amplify, for the corresponding frequency band, the correlated portion with respect to the non-correlated portion includes a subband processor being configured to apply, for the at least one frequency band, a first gain coefficient to the correlated portion of the at least one frequency band and a second gain coefficient different from the first gain coefficient to the non-correlated portion of the at least one frequency band.

22. The system of claim 11, wherein each subband processor is further configured to, for the at least one frequency band, apply a first time delay to the correlated portion and apply a second time delay different from the first time delay to the non-correlated portion.

23. A non-transitory computer readable medium configured to store program code, the program code comprising instructions that when executed by a processor cause the processor to:

receive an input audio signal comprising a first input channel and a second input channel;

divide the first input channel into first subband components, each of the first subband components corresponding to one frequency band from a group of frequency bands, at least one frequency band of the group of frequency bands including a set of critical bands;

divide the second input channel into second subband components, each of the second subband components corresponding to one frequency band from the group of frequency bands;

generate, for each of the frequency bands, a correlated portion between a corresponding first subband component and a corresponding second subband component;

generate, for each of the frequency bands, a non-correlated portion between the corresponding first subband component and the corresponding second subband component;

amplify, for each of the frequency bands, the correlated portion with respect to the non-correlated portion to obtain an enhanced spatial component and an enhanced non-spatial component;

generate, for each of the frequency bands, an enhanced first subband component by obtaining a sum of the enhanced spatial component and the enhanced non-spatial component;

generate, for each of the frequency bands, an enhanced second subband component by obtaining a difference between the enhanced spatial component and the enhanced non-spatial component;

generate a first spatially enhanced channel by combining enhanced first subband components of the frequency bands; and generate a second spatially enhanced channel by combining enhanced second subband components of the frequency bands.

24. The non-transitory computer readable medium of claim 23, wherein a correlated portion between a first subband component and a second subband component of a frequency band includes non-spatial information of the frequency band, and wherein a non-correlated portion between the first subband component and the second subband component of the frequency band includes spatial information of the frequency band.

25. The non-transitory computer readable medium of claim 23, wherein the instructions when executed by the processor further cause the processor to:

generate a correlated portion between the first input channel and the second input channel;

generate a crosstalk compensation signal based on the correlated portion between the first input channel and the second input channel;

add the crosstalk compensation signal to the first spatially enhanced channel to generate a first precompensated channel; and add the crosstalk compensation signal to the second spatially enhanced channel to generate a second precompensated channel.

26. The non-transitory computer readable medium of claim 25, wherein the instructions when executed by the processor to cause the processor to generate the crosstalk compensation signal further cause the processor to:

generate the crosstalk compensation signal to remove estimated spectral defects in a frequency response of a subsequent crosstalk cancellation.

27. The non-transitory computer readable medium of claim 25, wherein the instructions when executed by the processor further cause the processor to:

divide the first precompensated channel into a first inband channel corresponding to an inband frequency and a first out of band channel corresponding to an out of band frequency;

divide the second precompensated channel into a second inband channel corresponding to the inband frequency and a second out of band channel corresponding to the out of band frequency;

generate a first crosstalk cancellation component to compensate for a first contralateral sound component contributed by the first inband channel;

generate a second crosstalk cancellation component to compensate for a second contralateral sound component contributed by the second inband channel;

combine the first inband channel, the second crosstalk cancellation component, and the first out of band channel to generate a first compensated channel; and combine the second inband channel, the first crosstalk cancellation component, and the second out of band channel to generate a second compensated channel.

28. The non-transitory computer readable medium of claim 27, wherein the instructions when executed by the processor to cause the processor to generate the first crosstalk cancellation component further cause the processor to:

estimate the first contralateral sound component contributed by the first inband channel;

and generate the first crosstalk cancellation component comprising an inverse of the estimated first contralateral sound component, and wherein the instructions when executed by the processor to cause the processor to generate the second crosstalk cancellation component further cause the processor to:

estimate the second contralateral sound component contributed by the second inband channel; and generate the second crosstalk cancellation component comprising an inverse of the estimated second contralateral sound component.

29. The non-transitory computer readable medium of claim 23, wherein the set of critical bands includes critical bands of a Bark scale.

30. The non-transitory computer readable medium of claim 23, wherein the instructions further cause the processor to determine the set of critical bands of the at least one frequency band by:

determining a long term average energy ratio between correlated components and non-correlated components of audio samples over the critical bands; and grouping contiguous critical bands according to the long term average energy ratios of the critical bands.

31. The non-transitory computer readable medium of claim 23, wherein the instructions that cause the processor to amplify, for each of the frequency bands, the correlated portion with respect to the non-correlated portion includes the instructions causing the processor to apply, for the at least one frequency band, a first gain coefficient to the correlated portion and a second gain coefficient different from the first gain coefficient to the non-correlated portion.

32. The non-transitory computer readable medium of claim 23, wherein the instructions further cause the processor to, for the at least one frequency band, apply a first time delay to the correlated portion of the at least one frequency band and apply a second time delay different from the first time delay to the non-correlated portion of the at least one frequency band.

* * * * *